US009879413B2

(12) United States Patent
Castelli

(10) Patent No.: US 9,879,413 B2
(45) Date of Patent: Jan. 30, 2018

(54) MODULAR STRUCTURAL SYSTEM

(71) Applicant: Settimio Castelli, Rome (IT)

(72) Inventor: Settimio Castelli, Rome (IT)

(73) Assignee: Settimio Castelli, Rome (IT)

( * ) Notice: Subject to any disclaimer, the term of this patent is extended or adjusted under 35 U.S.C. 154(b) by 0 days.

(21) Appl. No.: 15/021,464

(22) PCT Filed: Feb. 12, 2015

(86) PCT No.: PCT/IT2015/000034
§ 371 (c)(1),
(2) Date: Mar. 11, 2016

(87) PCT Pub. No.: WO2015/121886
PCT Pub. Date: Aug. 20, 2015

(65) Prior Publication Data

US 2016/0222643 A1 Aug. 4, 2016

(30) Foreign Application Priority Data

Feb. 13, 2014 (IT) ..... RM2014A0062

(51) Int. Cl.
*E04B 1/343* (2006.01)
*E04C 3/12* (2006.01)
(Continued)

(52) U.S. Cl.
CPC ..... *E04B 1/34305* (2013.01); *A63H 33/105* (2013.01); *E04B 1/1903* (2013.01);
(Continued)

(58) Field of Classification Search
CPC ..... E04B 1/34305; E04B 1/1903; E04B 1/30; E04B 1/34384; E04B 2001/1957;
(Continued)

(56) References Cited

U.S. PATENT DOCUMENTS 1,531,542 A * 3/1925 Cogshall ..... A63H 33/084
273/157 R
2,472,363 A * 6/1949 Blackinton ..... A63H 33/082
446/127

(Continued)

FOREIGN PATENT DOCUMENTS

DE 19845160 A1 * 4/2000 ..... A63H 33/105
DE 202014003122 U1 * 7/2014 ..... A63H 33/105

(Continued)

OTHER PUBLICATIONS

Righetti, Search Report and Written Opinion for ITRM20140062 dated Oct. 9, 2014.

*Primary Examiner* — Babajide A Demuren
(74) *Attorney, Agent, or Firm* — Greer, Burns & Crain; Gregory P. Einhorn

(57) ABSTRACT

The invention relates to a modular structural system obtained from the combination, in sliding engagement form, of generically elongated elements A, B, C, D having sections whose perimeter is provided with protrusions and recesses which, in the spatial development of the elements A, B, C, D, form sliding channels or tracks for mutual sliding of the elements which form the structural system. The structural system may also be provided with node elements C shaped so as to have two parallel opposite surfaces, one of which is provided with sliding channels or tracks for mutual male/female engagement in corresponding sliding channels or tracks and the other surface of which is provided with a permanent or releasable connection with other elements A, B, C, D at a connection angle of 0<a<180° with respect to said opposite surfaces. The structural system may also be provided with nodes A", B", C" instead of the node elements C.

31 Claims, 17 Drawing Sheets

(51) Int. Cl.

| | |
|---|---|
| ***E04C 3/28*** | (2006.01) |
| ***E04C 3/34*** | (2006.01) |
| ***A63H 33/10*** | (2006.01) |
| ***E04B 1/19*** | (2006.01) |
| ***E04B 1/30*** | (2006.01) |
| *E04C 3/20* | (2006.01) |
| *E04C 3/29* | (2006.01) |
| *E04C 3/36* | (2006.01) |
| *E04B 1/24* | (2006.01) |
| *E04B 1/26* | (2006.01) |
| *E04C 3/04* | (2006.01) |

(52) U.S. Cl.
CPC ..... *E04B 1/30* (2013.01); *E04B 1/34384* (2013.01); *E04C 3/12* (2013.01); *E04C 3/285* (2013.01); *E04C 3/34* (2013.01); *A47B 2230/0077* (2013.01); *A47B 2230/0081* (2013.01); *E04B 2001/1957* (2013.01); *E04B 2001/2406* (2013.01); *E04B 2001/2472* (2013.01); *E04B 2001/2475* (2013.01); *E04B 2001/2636* (2013.01); *E04B 2001/2672* (2013.01); *E04B 2001/2676* (2013.01); *E04C 3/20* (2013.01); *E04C 3/28* (2013.01); *E04C 3/29* (2013.01); *E04C 3/36* (2013.01); *E04C 2003/0417* (2013.01)

(58) Field of Classification Search
CPC ..... E04B 2001/2676; E04B 2001/2472; E04B 2001/2475; E04B 2001/2636; E04B 2001/2672; E04B 3/20; A63H 33/105; E04C 3/34; E04C 3/285; E04C 3/12; E04C 3/36; E04C 3/29; E04C 2003/0417; E04C 3/28; A47B 2230/0077; A47B 2230/0081
See application file for complete search history.

(56) References Cited

U.S. PATENT DOCUMENTS

| | | | | |
|---|---|---|---|---|
| 2,589,304 | A * | 3/1952 | Spangler | E01C 9/083 405/277 |
| 3,977,149 | A | 8/1976 | Haynes et al. | |
| 5,601,470 | A * | 2/1997 | Yao | A63F 9/10 273/157 R |
| 5,661,499 | A * | 8/1997 | Epshtein | H01Q 15/08 343/909 |
| 5,864,998 | A | 2/1999 | Loomer | |
| 6,450,853 | B1 * | 9/2002 | Larws | A63H 33/101 446/122 |
| 7,429,144 | B1 * | 9/2008 | Lai | E01C 9/004 404/34 |
| 8,671,640 | B1 * | 3/2014 | Thomas | E04B 2/18 446/122 |
| 8,789,325 | B2 * | 7/2014 | Verhaeghe | E04B 2/705 4/524 |
| 2009/0000235 | A1 | 1/2009 | Kieran et al. | |
| 2009/0197025 | A1 * | 8/2009 | Burst | E06B 3/26307 428/34.1 |
| 2015/0300020 | A1 * | 10/2015 | Kobelev | E04C 3/00 52/846 |

FOREIGN PATENT DOCUMENTS

| | | | | |
|---|---|---|---|---|
| EP | 1639930 | A2 | 3/2006 | |
| FR | 2545163 | A1 * | 11/1984 | A63H 33/105 |
| GB | 1052110 | | 12/1966 | |
| GB | 2297336 | A | 7/1996 | |
| GB | 2467344 | A | 8/2010 | |
| NL | 8602335 | A | 4/1988 | |
| WO | 0177220 | A2 | 10/2001 | |
| WO | 2010020829 | A1 | 2/2010 | |

* cited by examiner

16/17

MODULAR STRUCTURAL SYSTEM

This application is a national phase application claiming benefit of priority under 35 U.S.C. §371 to International (PCT) Patent Application serial number PCT/IT2015/000034, filed Feb. 12, 2015, which claims benefit of priority to Italian patent application RM2014A000062, filed Feb. 13, 2014. The aforementioned applications are expressly incorporated herein by reference in their entirety and for all purposes.

FIELD OF THE INVENTION

The present invention relates to a modular structural system which can be used in various sectors, mainly the construction sector, but also in all those application sectors where there is a need for manufactured objects which are able to suitably resist mechanical stresses which cannot be effectively opposed by corresponding monolithic systems.

PRIOR ART

The structural systems known hitherto are substantially monolithic. The most well-known and universally used systems are pillars and beams described hereinbelow (source: Wikipedia under the headings: "pillar" and "beam").

A pillar is typically made of reinforced concrete, consisting namely of concrete and steel bars (reinforcement) embedded therein and suitably shaped and connected together.

A pillar is a vertical load-bearing architectural element which transfers the loads from the overstructure to the underlying structures designed to support it. The particular feature of the pillar consists in the form which is imagined to be vertical (namely obtained from a base which extends perpendicularly to the plane containing it); this flat base may be square, rectangular, polygonal or more complex (with multiple lobes, bundle-shaped, etc.). or also circular. The cross-section may have a constant form and size or variable form and/or size, in which case it is referred to as a "tapered pillar".

"Beam" is understood as meaning a structural element with a predominant dimension which is designed to transfer a stress tendentially transverse to its geometrical axis along said axis, from the sections acted on by the load to the constraining points, which ensure the external equilibrium of the beam, securing it to the surroundings. A mechanical system composed of beams which are fastened together and to the ground is called a "truss work" or "frame". This system constitutes one of the most important structural configurations used in constructions. In a regularly shaped frame, the pillars form the vertical interplanar elements, while the beams indicate specifically the horizontal planar elements.

A fundamental characteristic feature of beams consists in their static behaviour. The term "beams" more correctly refers to a condition where there is a mainly flexural behaviour while the term "pillars" refers to a condition where the behaviour consists mainly of a perpendicular force.

There exist construction systems with modular elements which may however be combined with each other, but the known systems are unable to provide a suitable resistance to the shearing, tractional, bending, compression and twisting stresses and generally have discontinuous lines which weaken the structure.

The present invention does not relate to constructional elements which form walls.

DESCRIPTION OF THE INVENTION

Below the terms "groove", "recess", "channel", "spline" and "track" will be understood as being synonyms, and likewise the terms "projection" and "protrusion" are to be regarded as synonyms.

According to the present invention it is understood that:

- "structural element" refers to each single element A, B, C, C', D or their alternative embodiments as described and illustrated below;
- "structural system" refers to the set of elements A, B and optionally C and optional elements D, said "structural system" being able to be further provided with node elements C;
- "structural assembly" refers to the combination of at least two structural systems which are connected by means of a node element C', the "structural assembly" preferably comprises a plurality of "structural systems" connected together by means of one or more node elements C' or by means of nodes A", B", C".

According to the present invention a composite or modular structural system with a predefined section is provided, said system being obtained from the combination, in sliding engagement form, of generically elongated elements, wherein said elements are of at least two different types and may be assembled together slidingly so as to form a variety of three-dimensional constructional structures. The structures may be building structures or mechanical structures or construction games or ornamental objects.

The structural system according to the invention may be structured in space with a both vertical and horizontal development, the connection between the two directions of development being obtained by means of one or more node elements or by means of nodes.

The system according to the invention has a predefined section and its spatial development is obtained along a main line which is perpendicular to the section; said system comprises:

- a first element A with a generically elongated shape having a generically quadrangular section whose perimeter is provided with protrusions and recesses or grooves which, in the spatial development of the element A, form sliding channels or tracks for mutual sliding of the elements which form the composite structural system, the external perimeter of said element A being substantially completely surrounded by perimeter portions of elements B;
- second elements B having a section whose perimeter is provided with protrusions and recesses or grooves which, in the spatial development of the element B, form sliding channels or tracks for mutual sliding of the elements which form the composite structural system, the perimeter of said element B being such that part of it may be inserted inside portions of the perimeter of A with mutual male/female engagement, while the remaining perimeter of B either defines perimeter portions of the section of the structural element or constitutes an element for insertion into perimeter portions of optional third elements C and optional elements D by means of mutual male/female engagement;
- optional third elements C having a section whose perimeter is such that part of it may be inserted in portions of the perimeter of B and in perimeter portions of optional other elements C and optional elements D with mutual male/female engagement, while the remaining perimeter portions of C define external perimeter portions of the overall final section of the composite or modular structural system; perimeter portions of said elements C and optional elements D substantially completely surrounding the perimeter portions of the elements B that are not engaged during mutual sliding with the element A;

optional further elements D having sections whose perimeter is such that part of it is inserted in portions of the perimeter of C and optionally of B with a mutual male/female engagement, while the remaining perimeter portions of D define external perimeter portions of the overall final section of the composite or modular structural system.

In a particular embodiment indicated with C', the element generically indicated by C is shaped so as to have two opposite surfaces, substantially parallel to each other, having a surface area which is bigger than the surface area of the remaining pairs of opposite surfaces. One of these two extended surfaces is provided with protrusions and sliding channels or tracks for mutual male/female engagement in corresponding sliding channels or tracks of second elements B and optional elements C and optional elements D, and the opposite parallel surface is provided with a permanent or releasable connection with said first element A and second elements B and optional other elements C and optional elements D at a connection angle of $0<\alpha<180°$ with respect to said opposite surfaces, preferably $0<\alpha<90°$, and more preferably $\alpha=90°$.

The permanent or releasable connection may be obtained in any known manner, for example using parts connected together using fixing means or systems chosen from: screws, bolts, glues, welds, pins, clinching, riveting, hemming, sealing, screwing, interlocking engagement or snap-engagement, etc., or may also be formed as an integral or monolithic element between the element C and the various other elements A, B, C, D.

From a geometrical point of view the elements A, B, C, D, C' may be defined as solids generated from a flat figure which moves in space and remains substantially orthogonal to the trajectories described by its points. The trajectory of the barycentre of the flat figure is said axial line, while the flat figure forms the section of each element A, B, C, D, C'. In the linear development of the elements the protrusions and recesses of the sections of A, B, C, D and C', in the linear development of the said section, form protrusions and sliding channels or tracks. The internal shape of the section may be solid in order to produce a solid element or entirely or partly hollow in order to produce a box-like or hollow element.

The engagement between the various elements A, B, C, D, C' is in the form of sliding engagement of the male/female type, for example a male dovetail, which is designed with dimensions suitable for engaging with a corresponding female dovetail on other elements so that said elements are engaged together in a sliding manner.

In the elongated spatial development of the structural system according to the invention each element A, B, C, D, C' may be superimposed on or combined with or added onto a corresponding other element A, B, C, D with a section substantially identical thereto, made of the same material or different material.

The structural elements A, B, C, D, C' are generated by means of the three-dimensional development of a flat geometrical "base" figure along a direction generally perpendicular to the plane in which said figure lies. This geometrical figure, generating the single element A, B, C, D, C', is formed by a perimeter and by a surface inside the perimeter. The morphology of the elements A, B, C, D, C' is therefore characterized by a superficial solid casing, defined by the development of the perimeter of the base figure along the desired height, and by an internal solid volume, defined by the development of the surface inside the perimeter of the base figure over the height which is to be given to the element. The shape and dimensions of the flat "base" figure of each single element, as well as the height of the said element, are defined, configured and designed depending on the requisites which the element will be able to satisfy (singly or as an assembly formed by the structural elements A, B, C, D, C') and therefore the performance features which the structural system according to the invention will ensure for its uses.

The structural elements A, B, C, D, C' can be made hollow internally, with variable thicknesses, Each structural element A, B, C, D, C' of a given length may be formed piece-by-piece with portions of further elements A, B, C, D, C' until the desired length is obtained. The piece-wise composition/segmentation may be performed also in a manner not orthogonal to the axis of development of the element.

In addition each structural element A, B, C, D, C' may be formed piece-by-piece such that the set of parts recompose the geometric shape of the single element, an example of this embodiment being shown in FIG. 34.

The structural system of the invention is obtained from the combination of a central element A with one or more elements B structurally connected around A and optional elements C and optional elements D structurally connected around B and not around A. Such spatial organization of the structural system is designed to form linear structures, which are typically vertical and horizontal, in the form of a structural assembly, for example in the form of pillars and beams whereby curvilinear structures are also possible, as for example shown in FIG. 28.

Advantageously, the structural system according to the invention has an overall section with an outer perimeter in the form of a regular polygon or a circle: particularly preferred are square and rectangular sections.

The proportions and the ratios between concave parts and convex parts of the sections of the elements A, B, C, D and C' are such as to ensure the complementary nature of said elements with respect to each other.

The distribution of volumes and corresponding sections of the single elements A, B, C, D, C' can be managed at the level of adjacent pairs, A with B (A-B), B with C (B-C), C with D (C-D), B with C and D (B-C-D) but not A with C and A with D in that the dimensions and variables may be distributed only between adjacent and/or bordering elements, as for example illustrated in the figures that show in cross-section shapes and geometries of various embodiments of elements A, B, C, D.

The structural system may have a predefined length and may be obtained by assembling the elements A and B and optional elements C and optional elements D having lengths different from each other until the predefined length of the structural element as a whole is obtained, as schematically shown in FIG. 13.

The single elements are defined by the three-dimensional development (along a directrix orthogonal to the plane in which the figure itself lies) of each geometrical base figure. Each structural element is joined, or rather assembled, together with the adjacent element by means of an operation which may be performed by means of insertion and sliding of the outer portions of the edges relative to each other. One of the methods may be as follows: on one end of the first structural element A each second element B and then in sequence each optional element C and optional element D are slidably assembled. The insertion procedure is performed making use of the external geometrical characteristics of each element and is ensured by the presence of concave and convex portions, i.e. protrusions and recesses, complementing each other. The latter guarantee also perfect joining together and assembly of the elements so that, once joined, it is no longer possible to separate them (unless the reverse procedure is carried out).

This procedure is repeated for all the simple structural elements of the invention until the combined structural system is configured in its completed form, namely as designed in order to satisfy all the given requirements.

The materials from which each single structural element may be made, may be of a varying nature and chosen from: metals and alloys, polymeric materials, ceramics, glass, wood, natural stone, agglomerates, conglomerates and composite materials, such as metallic and non-metallic laminates, and combinations thereof. The materials can be chosen from among: bulk materials, reticular materials, cellular materials with open and or closed cells, and stratified materials. The single elements A, B, C, D, C' may also be hollow and in this case it is possible to choose materials to make the casing of the structural element and other materials to fill the volume inside the casing. The casing can have a constant or variable thickness or the internal volume may be filled entirely or partly with gas, for example chosen from: air, inert gas, or liquids such as cooling or heating liquids or solids as mentioned above or corresponding combinations of gases, liquids and solids, as illustrated in FIG. 34.

The modular structural system according to the invention may be advantageously used in various sectors such as the construction and mechanical engineering industries, transportation and furnishing sectors, as well as in all those application sectors where different types and degrees of stresses must be simultaneously dealt with. The modular structural system according to the invention may also be advantageously used to provide modular games and construction games.

The structural system according to the invention is a cooperative system since it is able to achieve the combined and simultaneous synergy of the various structural elements which, independently of each other, may be composed and combined piece-wise with other portions of modular elements having geometrical features which are substantially the same and made of different types of materials, which are identified, prechosen and configured individually on the basis of their specific characteristics and performance features so as to optimize the functions and aims which are required of them. By optimizing the functions and aims of the single elements it is possible to achieve an improvement in performance of the entire structural system compared to corresponding structures of the same size and weight.

The organization of the structural assembly according to the invention constitutes the most effective response for meeting the design requirements.

Basically, with the structural system according to the invention, it is possible to provide each element or portion thereof with specific characteristics and requisites suitable for developing a cooperative structural system able to satisfy all the required combinations of performance features.

With the structural system according to the invention it is possible to achieve an optimization and therefore increase in the performance features, in terms of resistance to the simple and composite shearing, compressive, tractional, torsional, bending and other stresses, compared to corresponding structures of the same size and/or weight.

With the structural system according to invention it is also possible to rationalize and therefore reduce the quantities of materials used (for example in terms of thicknesses, weights, etc.) owing to the fact that it is possible to provide each modular element only with those mechanical properties which are absolutely necessary for satisfying the combination of forces which this element will be subject to when performing the intended functions for which it has been designed, without creating any interference or imbalance between the elements which form the structure.

Each modular element may be made using different materials and may make up the structural element in different proportions. Furthermore the modular elements may be combined also without using further connection systems or devices, other than those elements which form the structural system, this favouring a reduction in the additional parts and greater ease of assembly.

The advantages described above allow the modular system according to the invention to be used in the most widely varying application fields, allowing the assembly times to be minimized, ensuring the simplicity, precision and rapidity of the assembly and disassembly operations, and limiting the use of auxiliary instruments or apparatus, such as tools, machinery and various equipment for assembly. Advantageously, but not exclusively, the structural system may be used to form for example support frames, scaffolding, cranes and raising and displacement devices, enclosures, protection means, safety barriers, furnishings, as well as structures for temporary and/or permanent facilities and temporary and/or permanent and emergency infrastructures.

An additional advantage in terms of protection of the environment and energy savings is provided by the possibility of disassembling the structural system, it being possible also to re-employ each single element separately for other uses, with consequent limitation of wastage and disposal costs.

Further objects will become clear from the detailed description of the invention below, with reference to preferred embodiments, it being understood however that variations are possible without departing from the scope of protection defined by the accompanying claims and with reference to the figures in the accompanying drawings.

BRIEF DESCRIPTION OF THE FIGURES

The invention will now be described, only by way of an illustrative and non-limiting example, with reference to the accompanying figures, in which.

DESCRIPTION OF A PREFERRED EMBODIMENT OF THE INVENTION

The attached figures show a preferred embodiment of a structural system according to the invention obtained by combining various embodiments of the elements A, B, C; D, the node elements C' and the nodes A", B", C", which allow interconnection with other four structural systems positioned orthogonally with respect to the first system in order to obtain a structural assembly according to the invention.

With particular reference to the attached FIGS. 1 to 6, these show a preferred embodiment of the elements A, B and C, which make up the modular structural system according to the invention.

Figure 2:
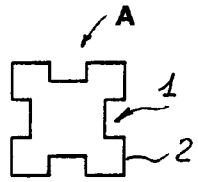
FIG. 2 schematically shows a cross-section of the element A of FIG. 1.
Figure 1:
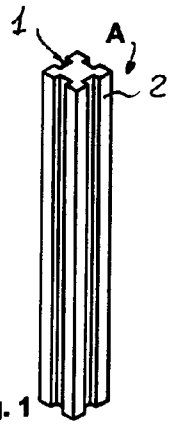
FIG. 1 schematically shows an axonometric view of the element A which forms part of the structural system according to the invention.
Figure 24:
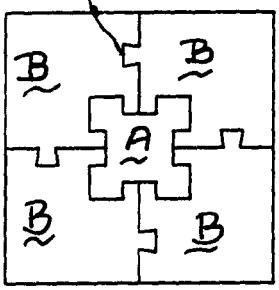
FIG. 24 schematically shows in cross-section the combination of the element A with four elements B.
Figure 25A:
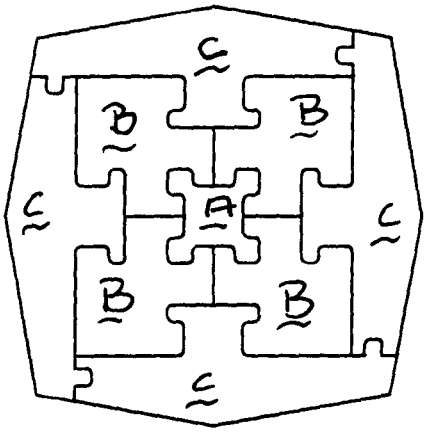
FIGS. 25*a*, 25*b*, 25*c*, 25*d*, 25*e*, 25*f*, 25*g* schematically show in cross-section different embodiments of the elements A, B, C with different sections, relative dimensional ratios and external shapes.
Figure 25B:
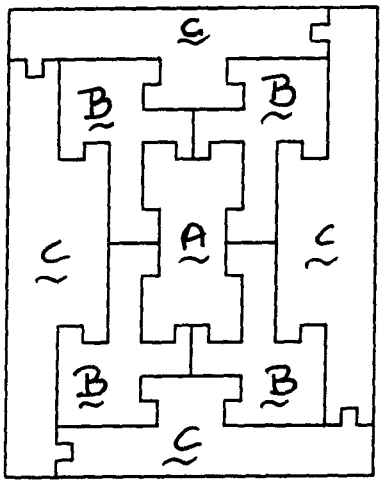
Figure 25C:
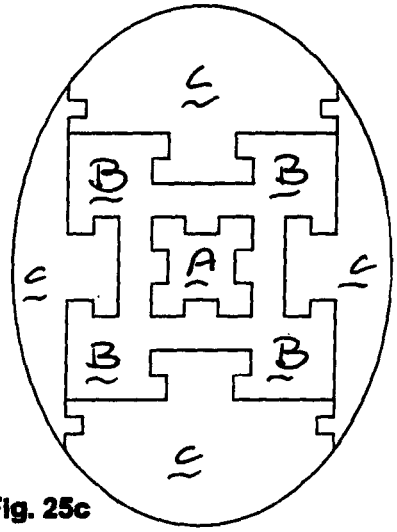
Figure 25D:
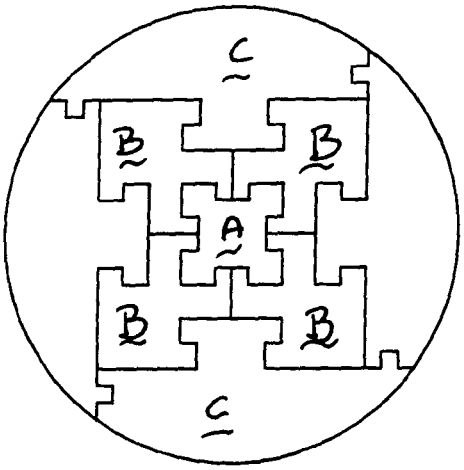
Figure 25E:
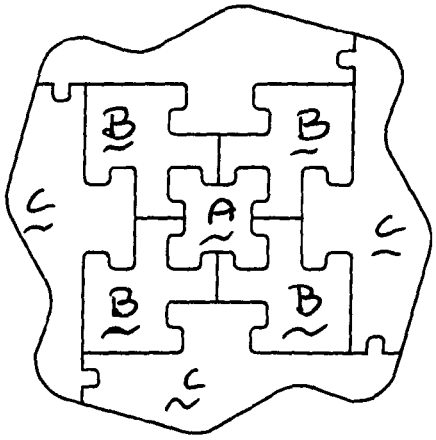
Figure 26A:
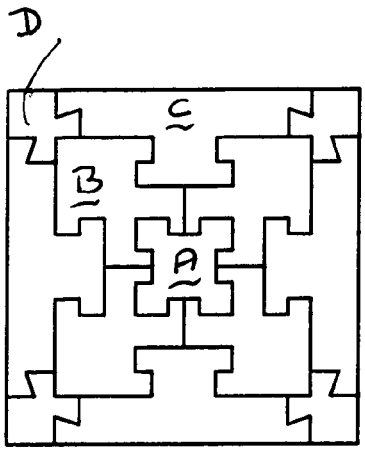
FIGS. 26*a*, 26*b*, 26*c*, 26*d* schematically show in cross-section different embodiments of the elements A, B, C, D with different relative dimensional ratios and external shapes.
Figure 26B:
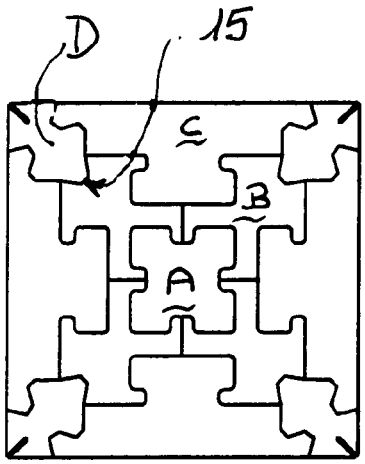
Figure 26C:
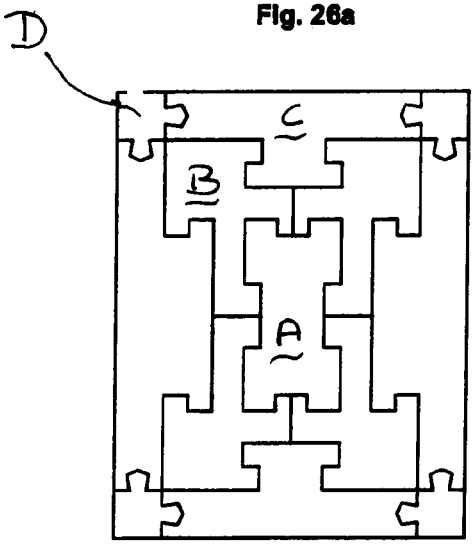
Figure 26D:
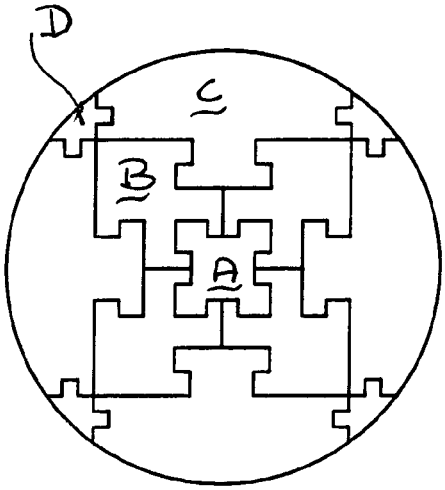
Figure 25F:
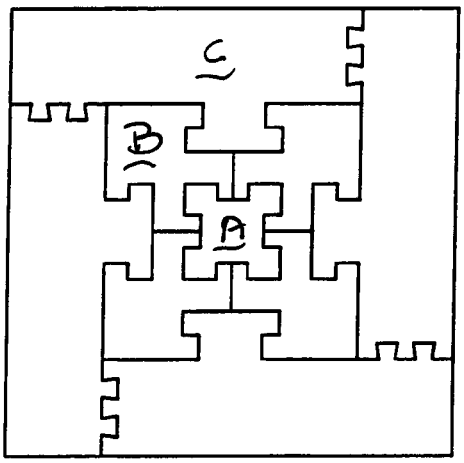
Figure 25G:
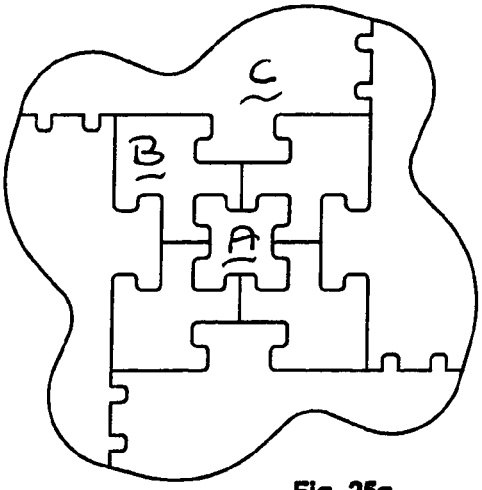

The element A, shown in the axonometric view of FIG. 1 and in the cross-section of FIG. 2 has a generically square section, as shown in particular in FIG. 2, or rectangular section, as shown in FIGS. 25*b* and 26*c*. In said element A sliding grooves or longitudinal tracks 1 are formed, symmetrically distributed on the four sides of the section. In FIGS. 1 and 2 and in FIGS. 24, 25*b*, 25*c*, 25*d*, 25*f*, 26*a* 26*c*, 26*d*, the guides shown are of the square type with parallel surfaces, but may be formed in any known manner suitable for allowing sliding of complementary parts, for example rounded or bevelled as shown in FIGS. 25*a*, 25*e*, 25*g* and 26*b*. The grooves or tracks 1 define projecting parts 2, which may also be shaped square or rounded or bevelled so as to be able to engage slidingly inside corresponding complementary grooves of a generic element B.

Figure 4:
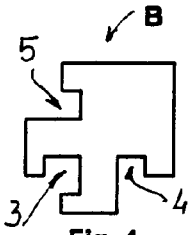
FIG. 4 schematically shows a cross-section of the element B of FIG. 3.
Figure 3:
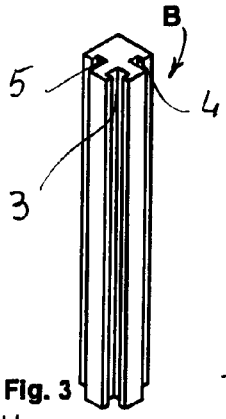
FIG. 3 schematically shows an axonometric view of the element B which forms part of the structural system according to the invention.

The element B, shown in the axonometric view of FIG. 3 and in the cross-section of FIG. 4, has a generically quadrangular section, as shown in particular in FIG. 4, which shows the sliding grooves or longitudinal tracks 3, and optional sliding grooves or longitudinal tracks 4 and 5 formed on one or three of the four corners of the section and also optional sliding grooves or longitudinal tracks 15 formed on the fourth of the four corners of the section, as shown in cross-section of FIG. 26*b*. Also the element B may have a generically rectangular section, as shown in particular in FIGS. 25*b* e 26*c*. In FIGS. 3, 4 and in FIGS. 24, 25*b*, 25*c*, 25*d*, 25*f*, 26*a*, 26*c* e 26*d* the grooves or tracks 3, 4, 15 are of the square type with parallel surfaces, but such tracks may be formed in any known manner suitable for allowing sliding of complementary parts, for example rounded or bevelled, as shown in FIGS. 25*a*, 25*e*, 25*g* and 26*b*. In the embodiment of FIG. 4 the grooves or tracks 4 and 5 are an identical mirror-image of each other and different from the track 3 which is shaped so that it can be coupled with and accommodate the projecting parts 2 of the element A. The grooves or tracks 4 and 5 are designed to engage slidingly with corresponding complementary protrusions of a generic element C or C'. In the embodiment of FIG. 24, the grooves or tracks 4 and 5 are replaced by grooves 16 and protrusions 17 and a structural system according to the invention may be formed only with the central element A, in this case having a generically square section, (or rectangular section, not shown), surrounded by four elements B. The section of a structural system realized with only elements A and B may be, other than square, as shown in FIG. 24, also polygonal, or rounded or generically with any design (embodiments not shown).

The embodiment shown in FIG. 26*b* has the additional groove or track 15 which is able to slidingly engage with corresponding complementary protrusion of a generic element D, whose section can have various shapes, as for example shown in FIGS. 26*a* to 20*d*. In this embodiment the structural system of the invention will be formed not only with the central element A (having a generically square or rectangular section), surrounded by four elements B, but also with additional four elements C and D.

With particular reference to FIG. 25*c*, this shows an embodiment in cross-section in which the four elements B are cast together as a monolithic element or monobloc which completely surrounds A.

Figure 6:
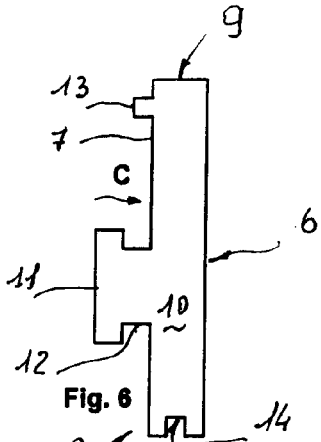
FIG. 6 schematically shows a cross-section of the element C of FIG. 5.
Figure 5B:
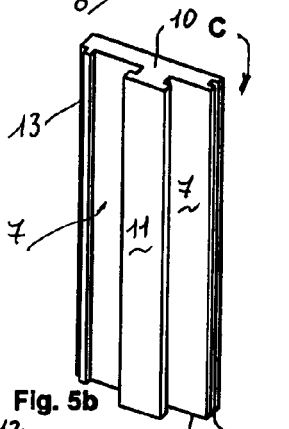
FIGS. 5*a* and 5*b* schematically show an axonometric front view (FIG. 5*a*) and rear view (FIG. 5*b*) of the element C which forms part of the structural system according to the invention.
Figure 5A:
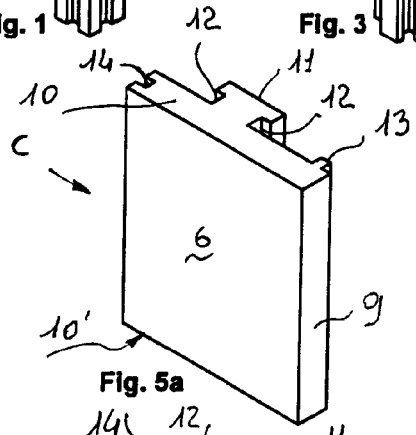

The element C, shown in the axonometric of FIGS. 5*a*, 5*b* and in cross-section in FIG. 6 is generically shaped so as to have two opposite surfaces 6, 7, substantially parallel to each other, having a surface area bigger than the surface area of the remaining pairs of parallel and opposite surfaces 8, 9 and 10, 10', the pairs of surfaces 10, 10' being identical to each other.

The surface 10 of the element C has a generically rectangular section, as shown in FIG. 6.

The extended surface 7 is provided with a protrusion 11 for forming two parallel and opposite sliding channels 12 and a protrusion 13 parallel to the channels 12 on the side where the lateral surface 9 is located. The lateral surface 8, parallel and opposite to the lateral surface 9, has a longitudinal groove or track 14 parallel to the channels 12.

In an embodiment shown only in cross-section (FIG. 25*c*) two alternate and opposite elements C have parallel sliding channels 14 able to slidingly engage with corresponding protrusions 13 formed on the other two alternate and parallel elements C.

In an embodiment shown only in cross-section (FIGS. 26*a* to 26*d*) the four alternate and opposite elements C have on their surfaces 8/9 protrusions/sliding channels 14 able to slidingly engage with corresponding channels/protrusions of additional elements D.

In an embodiments shown only in cross-section (FIGS. 25*f* and 25*g*) the elements C have double parallel sliding channels 14 able to slidingly engage with corresponding double protrusions 13 formed on other two adjacent elements C.

As shown in FIGS. 25*a* to 26*d*, the element C, optionally in combination with the element D, with its external perimeter portion which may have various shapes with different designs, helps form the external part of the structural system of the invention.

FIGS. 23*a* to 23*k* show different embodiments of the protrusion/channel joint which can be obtained on the lateral surfaces 8/9 of two elements C adjacent to each other. Some of the various embodiments are also shown in FIGS. 25*a* to 26*d*.

Figure 7:
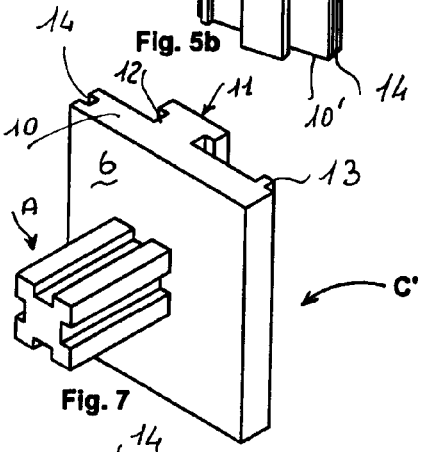
FIG. 7 schematically shows an axonometric view of a first embodiment of the node element C', which forms part of the structural system according to the invention.
Figure 8:
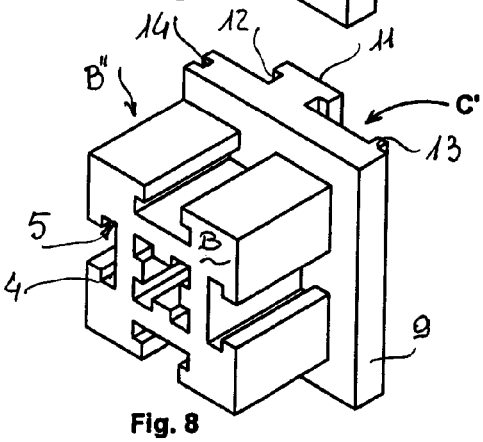
FIG. 8 schematically shows an axonometric view of a second embodiment of the node element C', which forms part of the structural system according to the invention.
Figure 9:
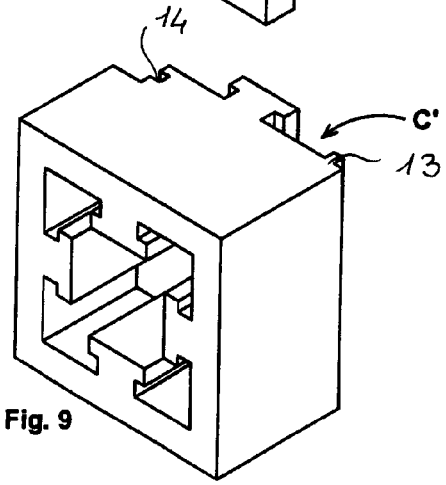
FIG. 9 schematically shows an axonometric view of a third embodiment of the node element C', which forms part of the structural system according to the invention.

The node element C' (FIGS. 7, 8 and 9) has the same sliding channels or tracks and protrusions as the element C, while it differs from the latter in that on the extended surface 6, which is parallel and opposite to the extended surface 7, it is further provided with a permanent or releasable connection with the element A (FIG. 7) or with elements B, which in FIG. 8 are shown cast together to form a monobloc, or with elements C, which in FIG. 9 are shown cast together to form a monobloc. The elements A, B, C are connected to the surface 6' at an angle $\alpha$ which in this embodiment forms an angle $\alpha$ of 90° with respect to the extended surface 6'.

In an embodiment, not shown, the connection on the surface 6' of said elements A, B, C may be performed at angles $\alpha \neq 90°$.

The grooves or tracks 12 and the protrusion 11 are designed to engage slidingly with corresponding complementary protrusions or tracks of generic elements B. The protrusions 13 and the grooves or tracks 14 are designed to engage slidingly with corresponding complementary tracks or protrusions of other generic elements C.

Again with reference to FIGS. 7-9, these show preferred embodiments of the node element C', which allow two or more structural systems to be interconnected with each other.

Figure 10:
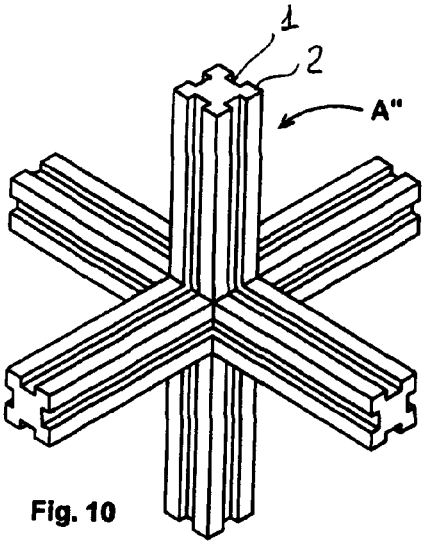
FIG. 10 schematically shows an axonometric view of the node A", which forms part of the structural system according to the invention.
Figure 11:
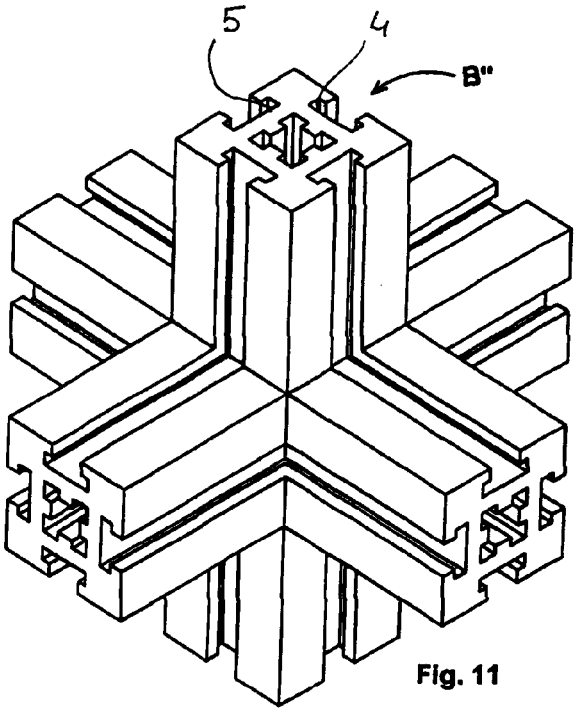
FIG. 11 schematically shows an axonometric view of the node B", which forms part of the structural system according to the invention.
Figure 12:
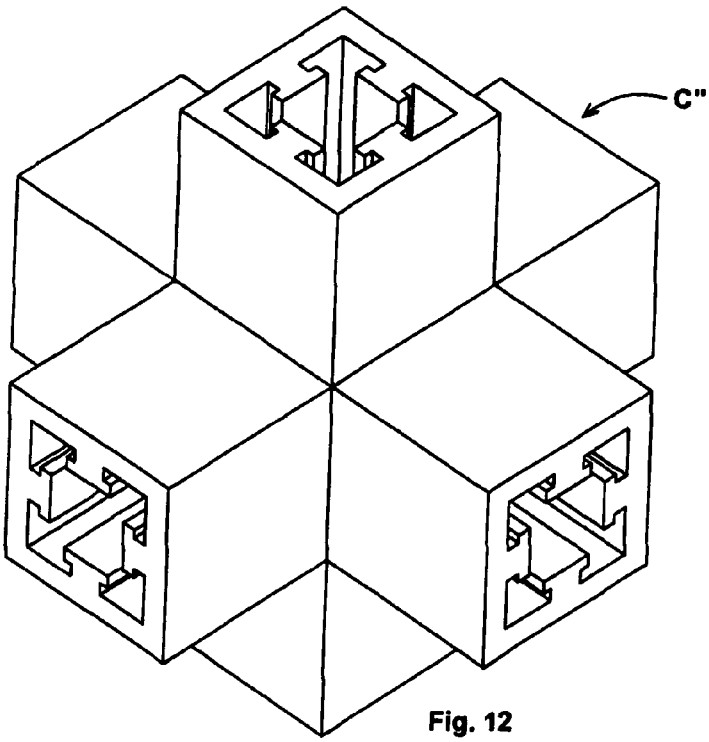
FIG. 12 schematically shows an axonometric view of the node C", which forms part of the structural system according to the invention.

FIGS. 10, 11*e* 12 are further embodiments of nodes which are an alternative to those obtainable with the elements C'. These further embodiments are obtained by means of the spatial arrangement of at least two elements at 90° with respect to each other. In the embodiment shown in FIG. 10 the node A" is obtained by the combination of six elements A originally cast together. In further embodiments (not shown) the node A" may be obtained by combining at least three elements originally cast together. The node B" is composed by at least three groups of four elements B originally cast together and FIG. 11 shows the node B" composed of six of these groups of four elements B, which in this figure are cast together to form a monobloc, the monoblocs being originally cast together. The node C" is composed of at least three groups of four elements C originally cast together and FIG. 12 shows the node C" composed of six of these groups of four elements C, which in this figure are cast together to form a monobloc, the monoblocs being originally cast together.

The connection between the vertical structural systems and the horizontal systems in order to obtain a structural assembly is performed by means of assembly using elements of type C', or node elements, or by means of the nodes A", B", C" which form a connection between the elements A, B, C and optional elements D of a first structural system for example arranged vertically, with a second structural system for example arranged horizontally with respect to the first system.

When the node is realized with elements C', the node is obtained by means of a sliding combination of the male/female type with other elements C and optional elements D and C'. In the case where the section of the vertical structural system is square or rectangular, each node will be formed by four elements C' identical to each other and the structural system may have up to four nodes. Each node element C' is positioned along the direction of extension of the following structural system which is to be connected to the preceding one, for example to obtain a structural complex formed by two or more structural systems at 90° relative to each other.

Further embodiments of the nodes A", B", C" are shown in FIGS. 10, 11, 12.

Figure 13:
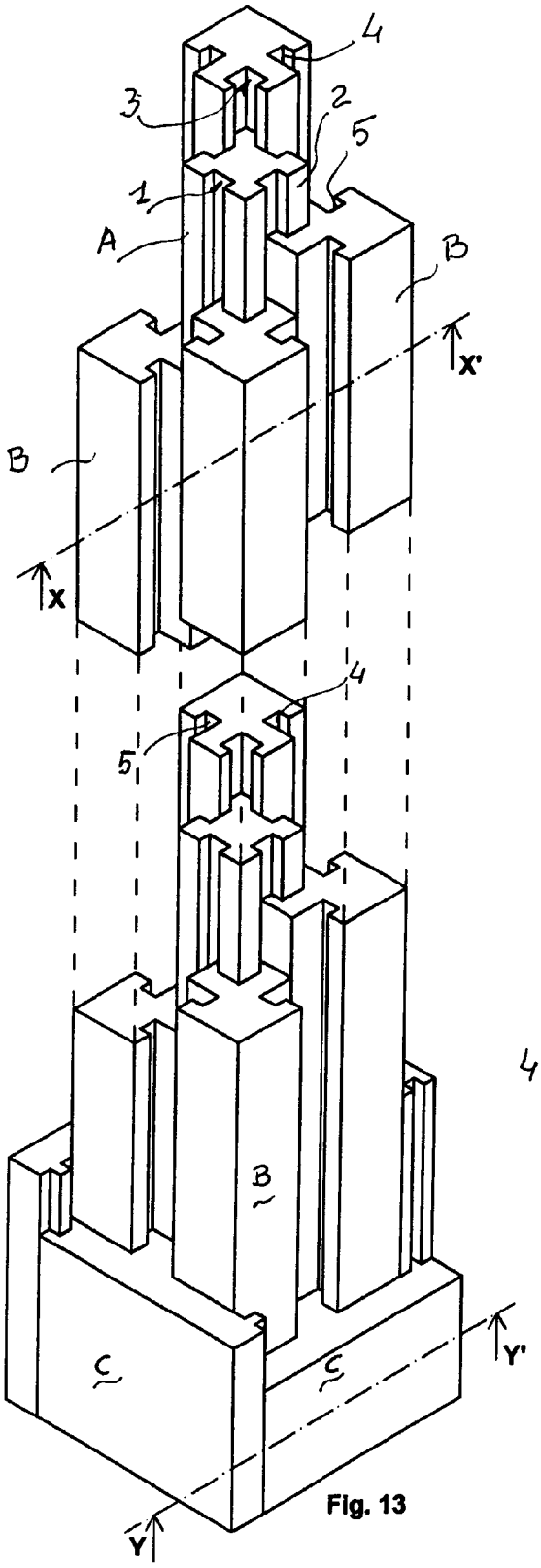
FIG. 13 schematically shows an axonometric view of a combination of the elements A, B and C of varying lengths.
Figure 14:
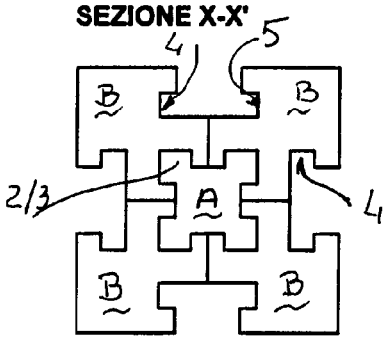
FIG. 14 schematically shows the cross-section along x-x indicated in the view of FIG. 13.
Figure 15:
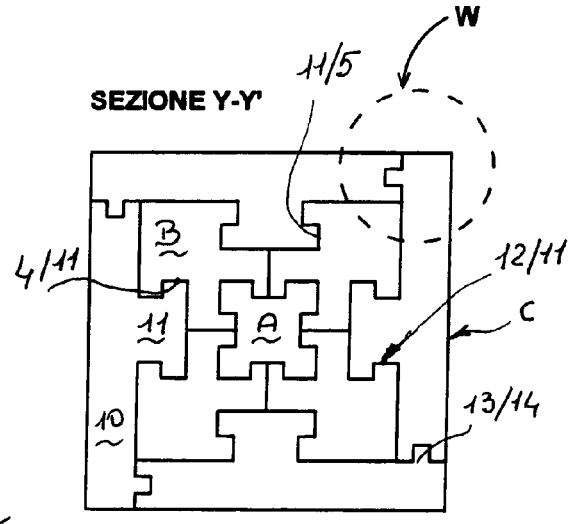
FIG. 15 schematically shows the cross-section along y-y indicated in the view of FIG. 13.

FIG. 13 and FIGS. 14 and 15 show, respectively, an axonometric view of a combination of the elements A, B and C and corresponding cross-sections x-x' and y-y'.

With particular reference to FIG. 13, this shows a structural system according to the invention, obtained by means of the sliding assembly of the central element A having, positioned around it, four elements B from which four elements C extend. FIG. 13 shows how the various elements A, B, C may have lengths which are different from each other.

FIG. 14 shows, along the cross-section x-x', the assembled arrangement of the element A and four elements B.

FIG. 15 shows, along the cross-section y-y', the assembled arrangement of the element A, four elements B and further four elements C. The detail in the circle W shows a way of connecting together two adjacent elements C. Other types of connection are shown in FIGS. 23*a* to 23*k*.

Figure 16:
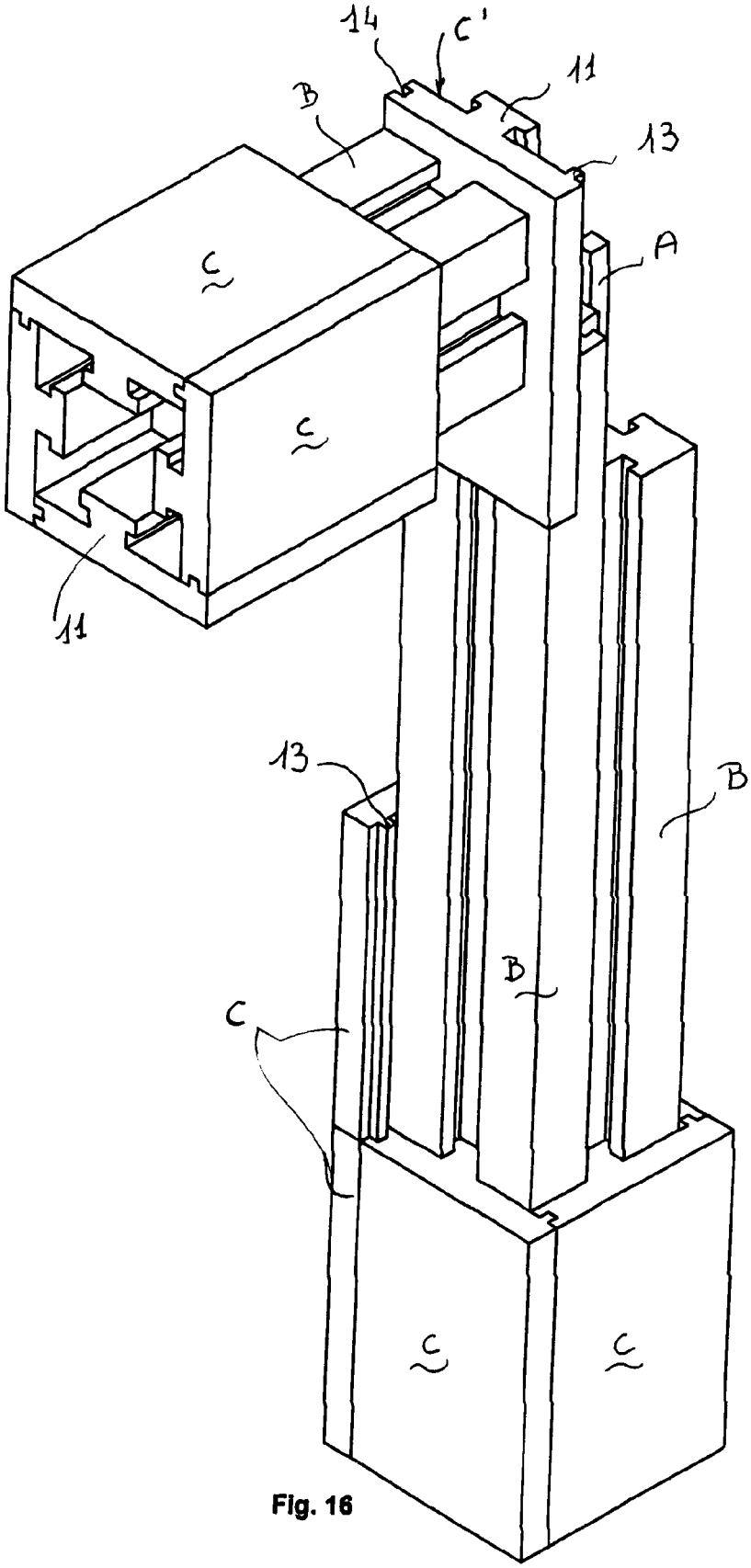
FIG. 16 schematically shows an axonometric right-hand view of the structural system according to FIG. 13 combined, by means of a node element C', with another structural system positioned orthogonally with respect to the first system.
Figure 17:
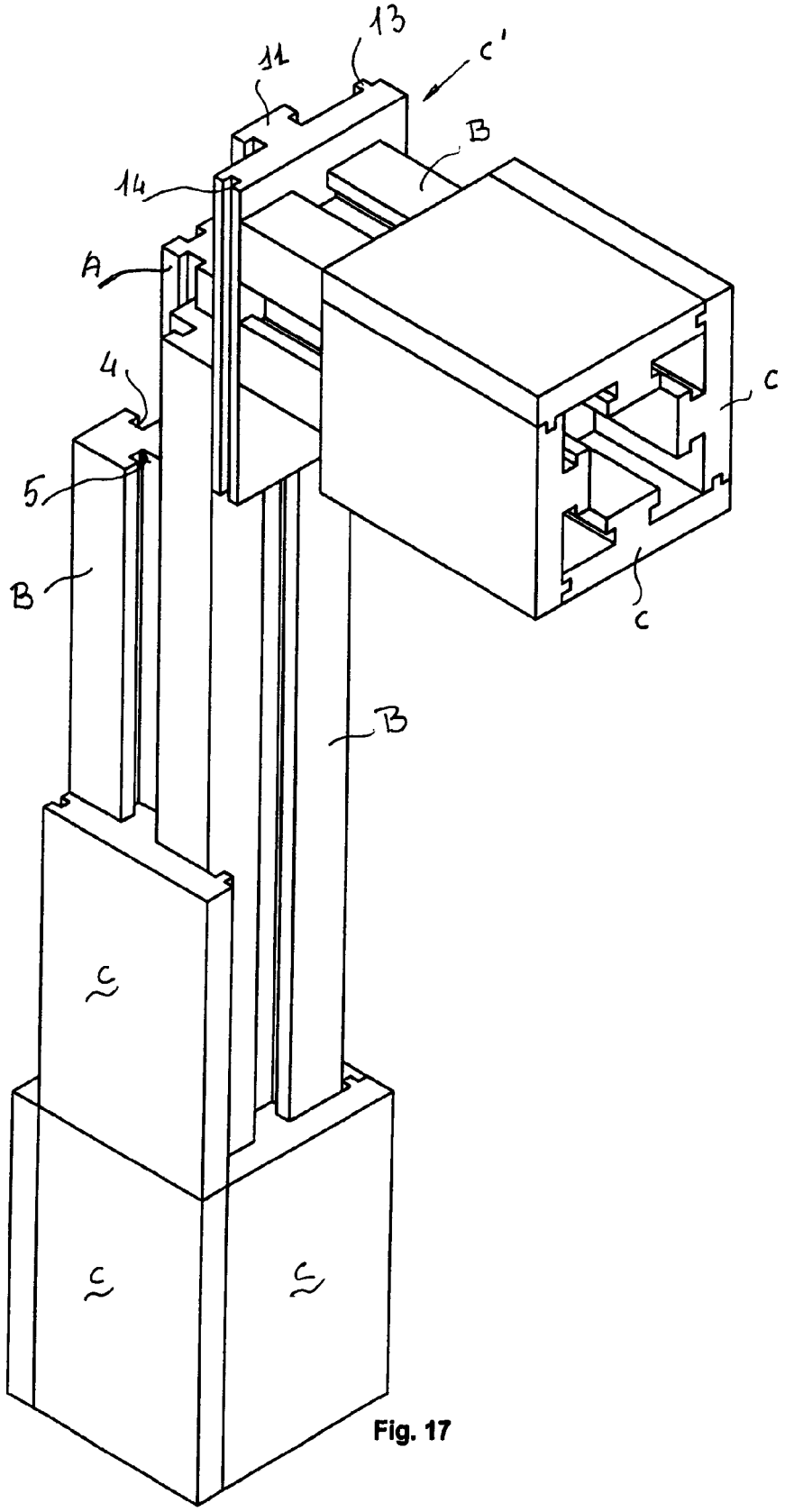
FIG. 17 schematically shows the same view as that of FIG. 16, in an axonometric view from the left.

With particular reference to FIGS. 16 and 17, these show a structural system according to the invention with a vertical extension, similar to that of FIG. 13. This vertical structural system may also be developed horizontally by using a node element C' which in the figure is positioned at the top and may slide longitudinally downwards until it reaches an element C which forms an abutment therewith, as shown in FIG. 19.

Figure 18:
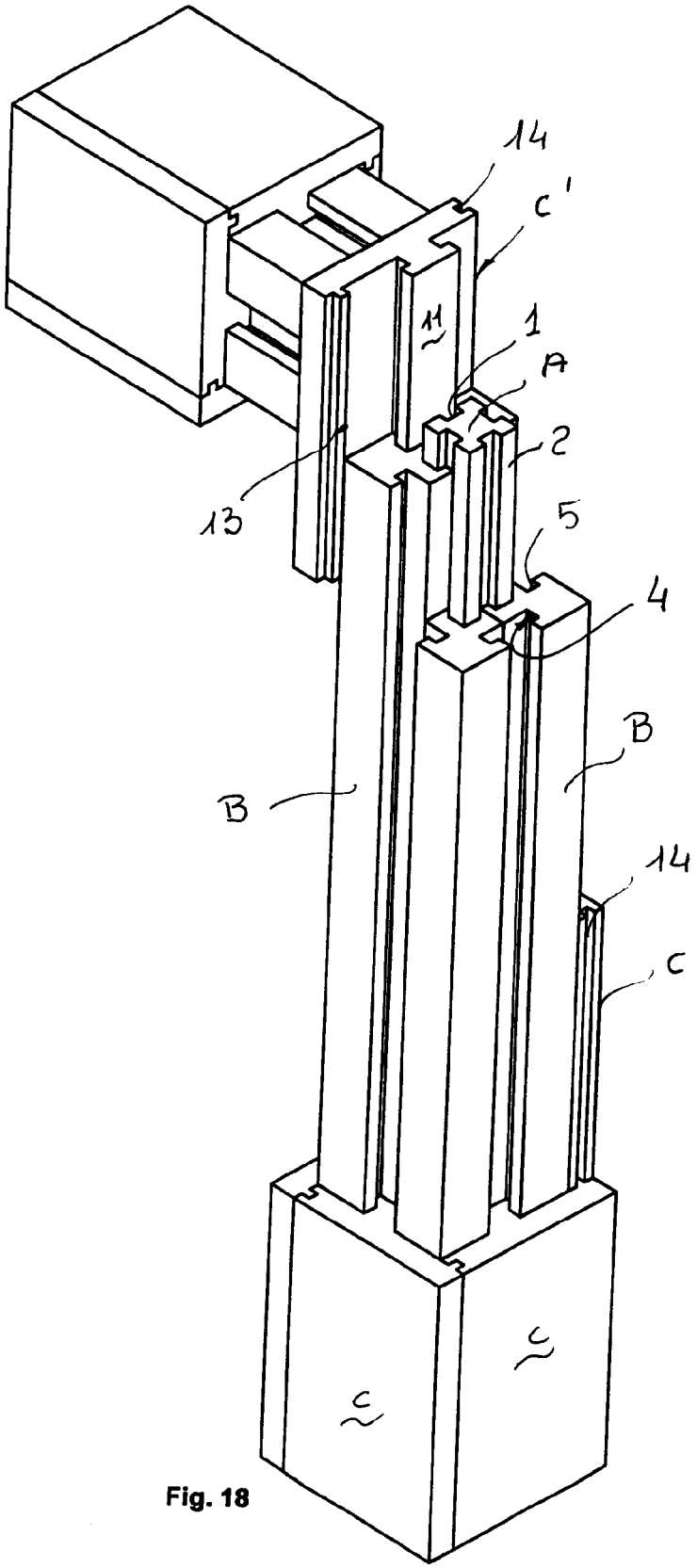
FIG. 18 schematically shows the same view as that of FIGS. 16 and 17, in an axonometric view from the rear.

Still with reference to FIGS. 16 and 17, these show the element C' which has, connected to it, other elements A, B, C arranged according to the invention to form a second structural system, orthogonal to the first system. In FIG. 18 it is also possible to see the sliding action of the node element C' with the protrusion 11 which engages slidingly inside the corresponding splines 4 and 5 created by two adjacent elements B.

FIGS. 16, 17 and 18 show the structural system composed of a central element A, four elements B and four elements C which are all interconnected slidingly, a second element C being positioned on one of the elements C.

Figure 19:
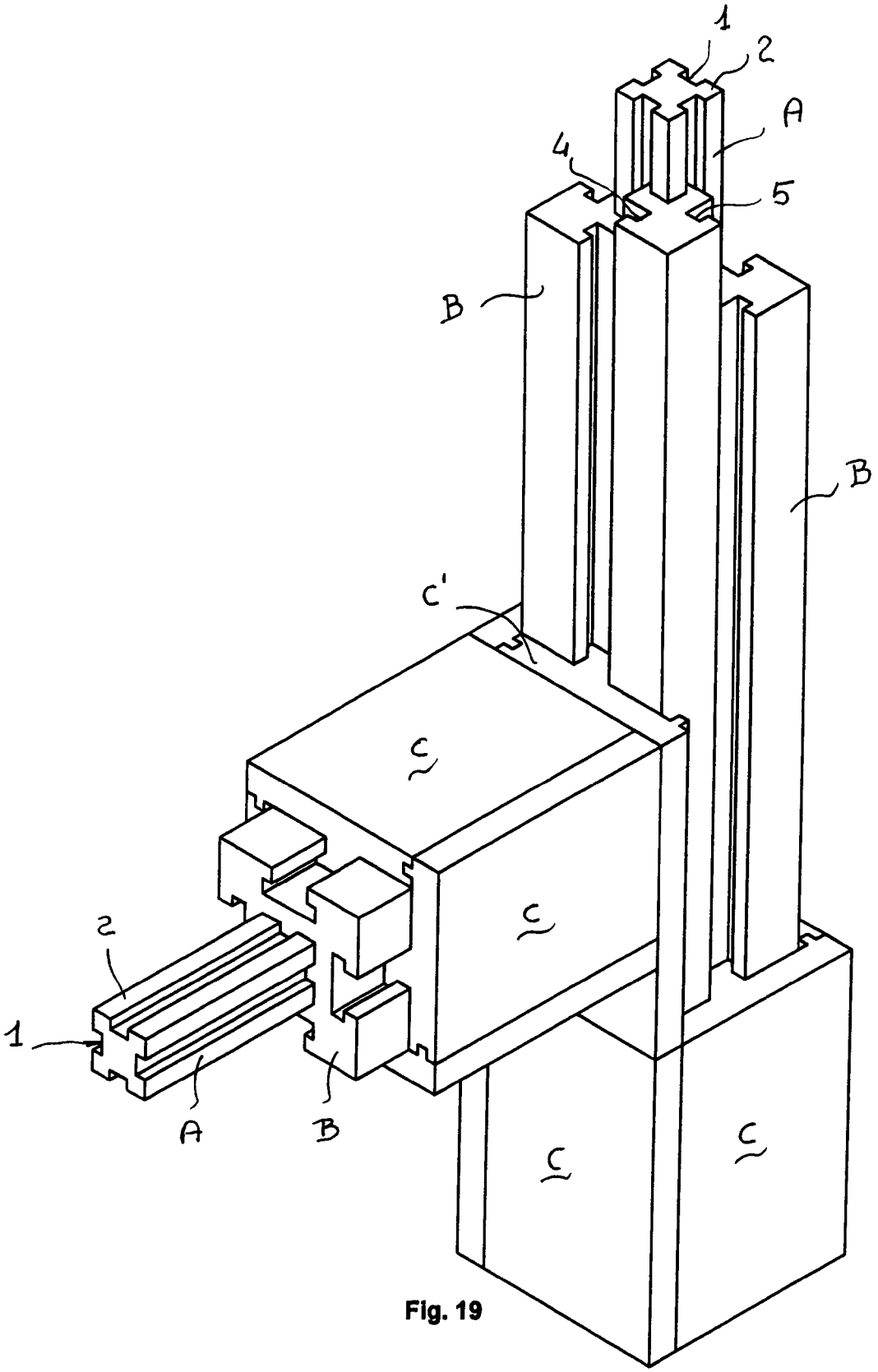
FIG. 19 schematically shows the same view as that of FIG. 16 with the orthogonal structural system lowered.

FIG. 19 shows the vertical structural system which is connected to a corresponding orthogonal structural system by means of the node element C' and where the element A of the orthogonal structural system is partly extracted from its seat or has a greater length than the corresponding elements B and C to which it is structurally connected, so as to form a male element for the horizontal development of the structure as a whole.

Figure 20:
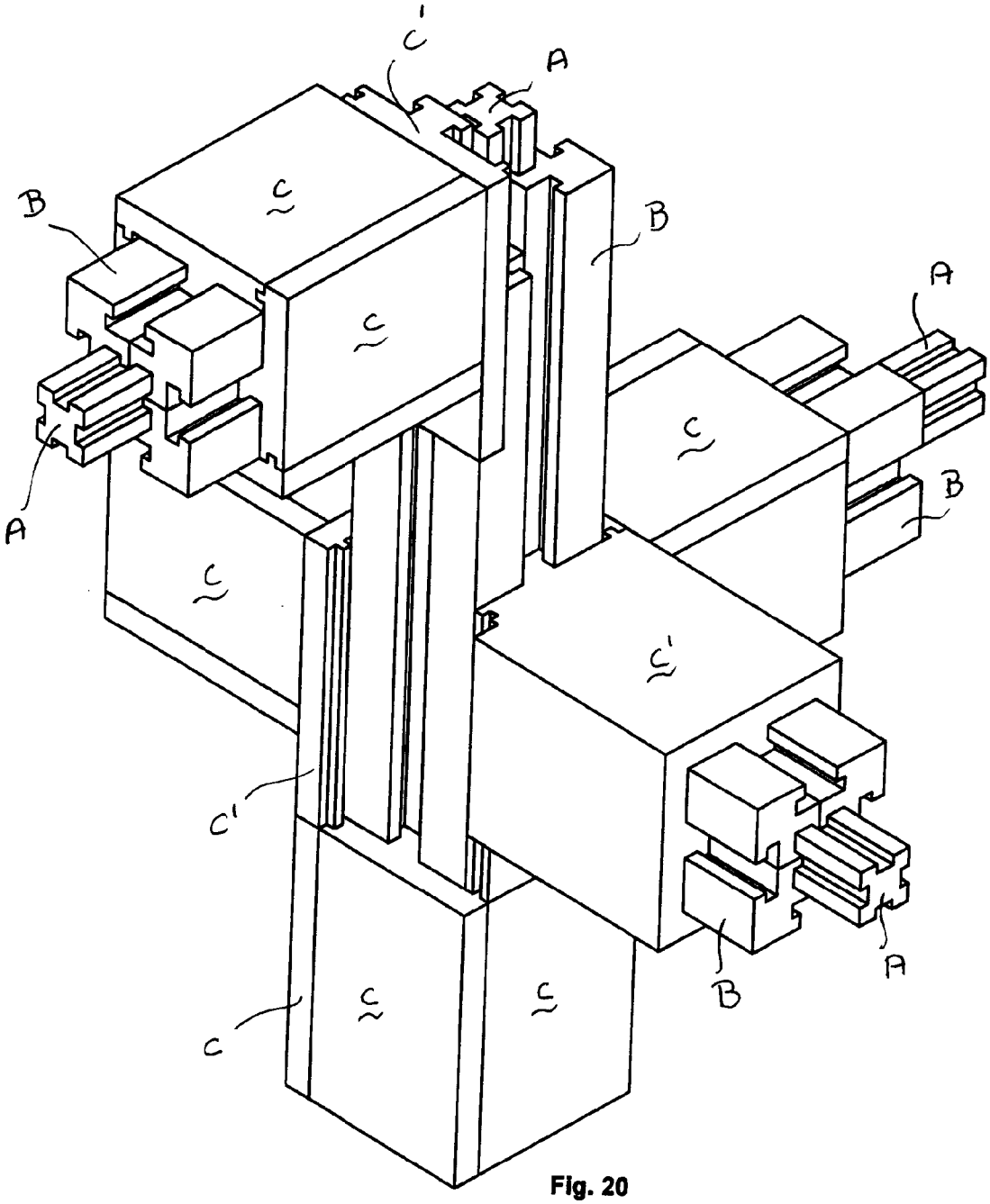
FIG. 20 schematically shows an axonometric view of a structural system combined with other four orthogonal structural systems by means of a corresponding number of node elements C', one of the four elements being at the top, during assembly/disassembly with respect to the other three elements.
Figure 21:
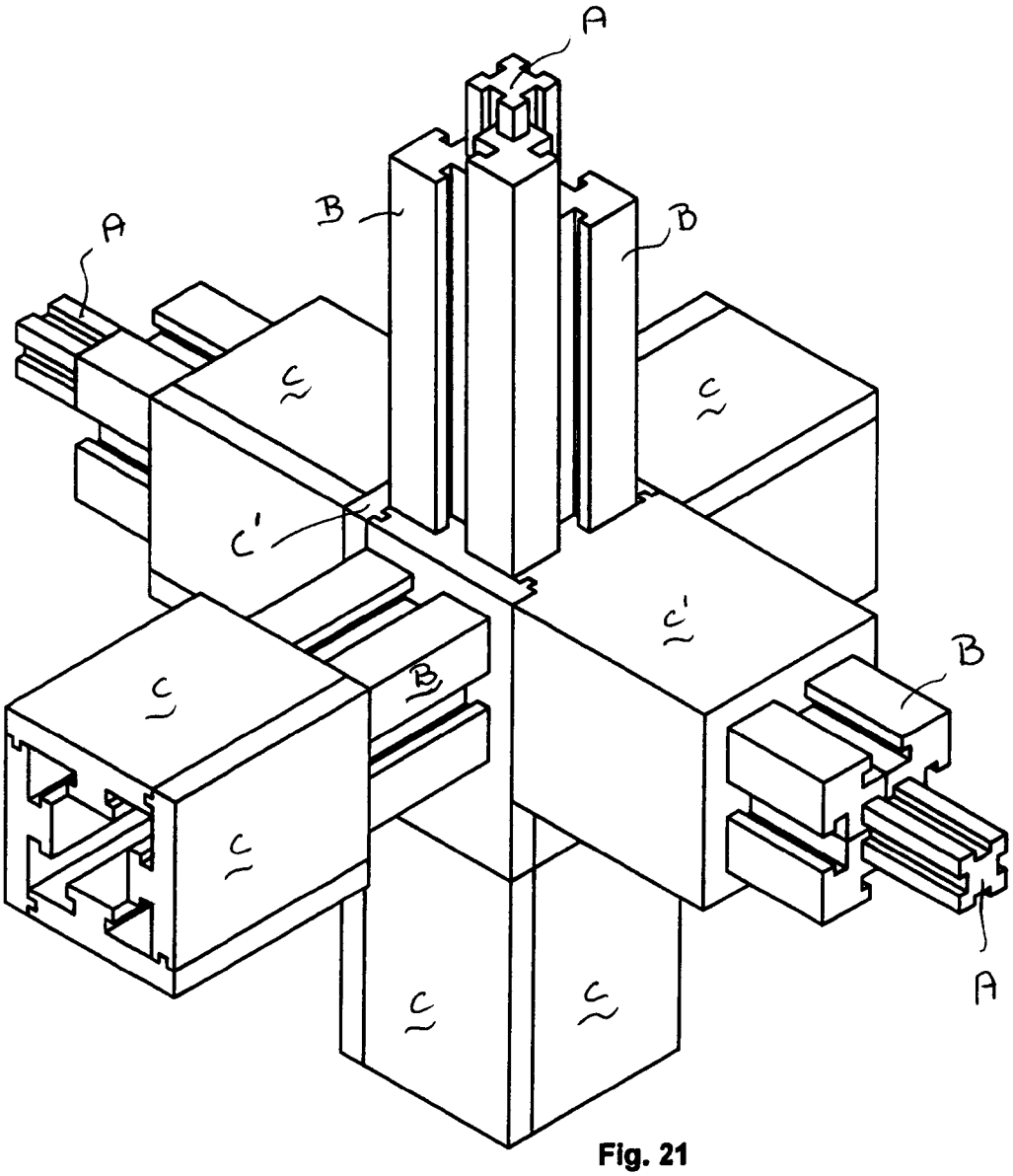
FIG. 21 schematically shows the same view as in FIG. 20, while the combination of four elements C is being inserted/removed.
Figure 22:
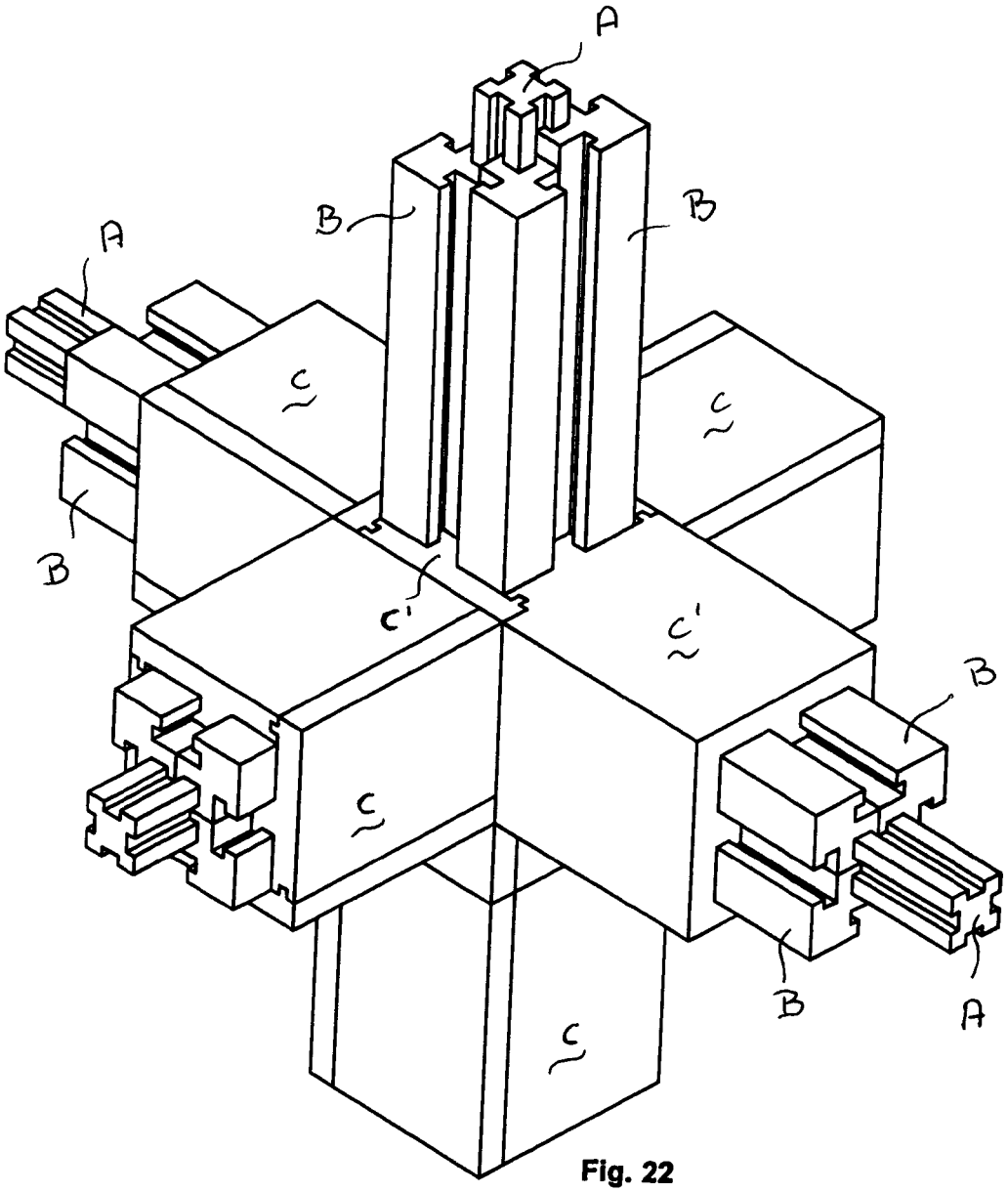
FIG. 22 schematically is an axonometric view of a structural system comprising four nodes, completely assembled, showing in particular male and female parts prepared for subsequent connections in order to obtain a structural assembly according to the present invention.
Figure 23A:
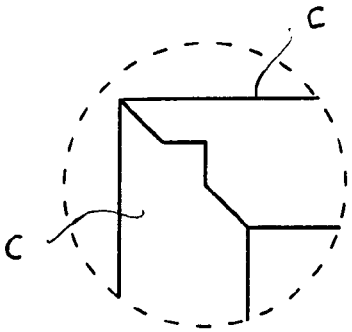
FIGS. 23*a*, 23*b*, 23*c*, 23*d*, 23*e*, 23*f*, 23*g*, 23*h*, 23*i*, 23*j*, 23*k* schematically show in cross-section the possible embodiments of the detail W encircled in FIG. 15.
Figure 23B:
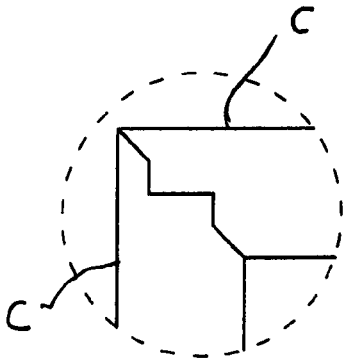
Figure 23C:
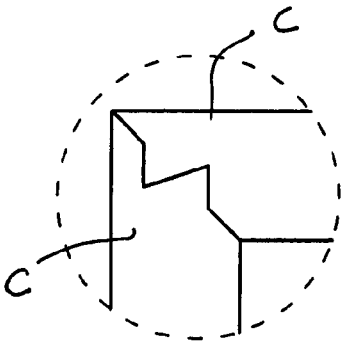
Figure 23D:
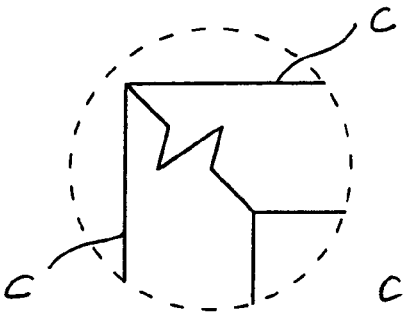
Figure 23E:
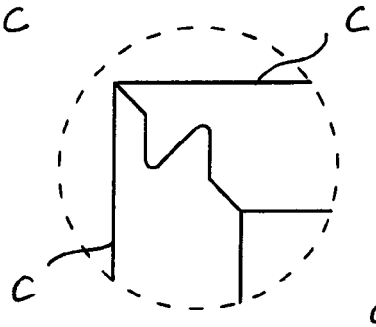
Figure 23F:
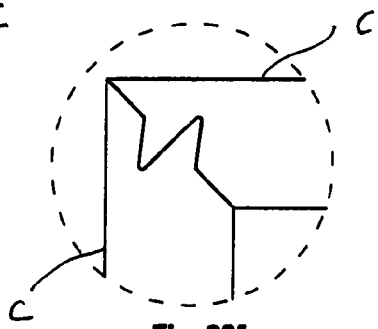
Figure 23G:
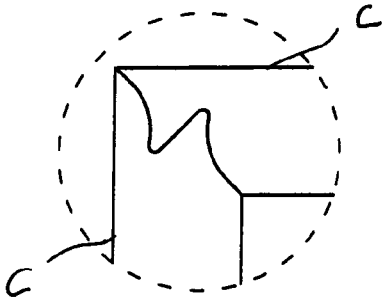
Figure 23H:
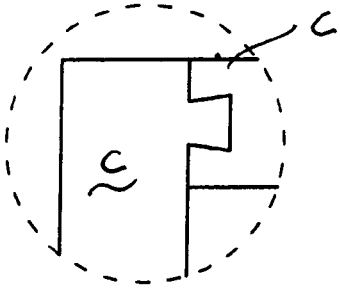
Figure 23I:
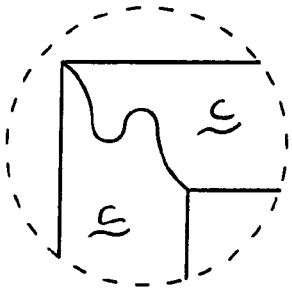
Figure 23J:
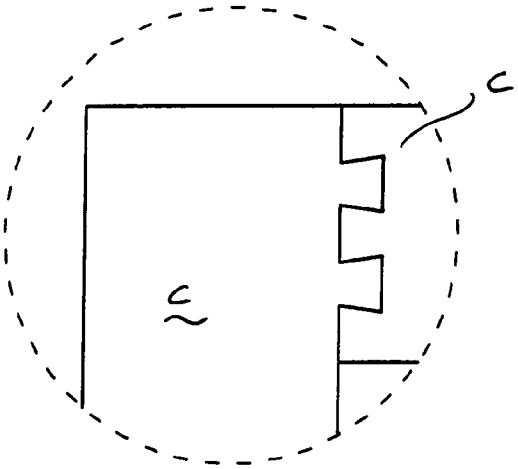
Figure 23K:
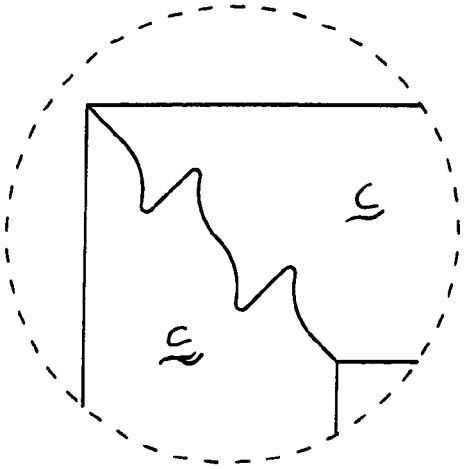

FIGS. 20, 21 and 22 show the embodiment consisting of four nodes each obtained by the combination of an element C' with respective elements A, B, C. As can be seen from the figures, the various elements A, B, C have different lengths so as to create sliding and extractable male/female connections for a three-dimensional development of the structural system according to the invention. In these figures one of the nodes is formed as a monobloc as shown in FIG. 9.

FIGS. 16 to 22 show how the elements A, B, C, C' of a structural system according to the invention, spatially organized in form of pillars and beams, can be extracted and are mutually slidable.

Figure 27:
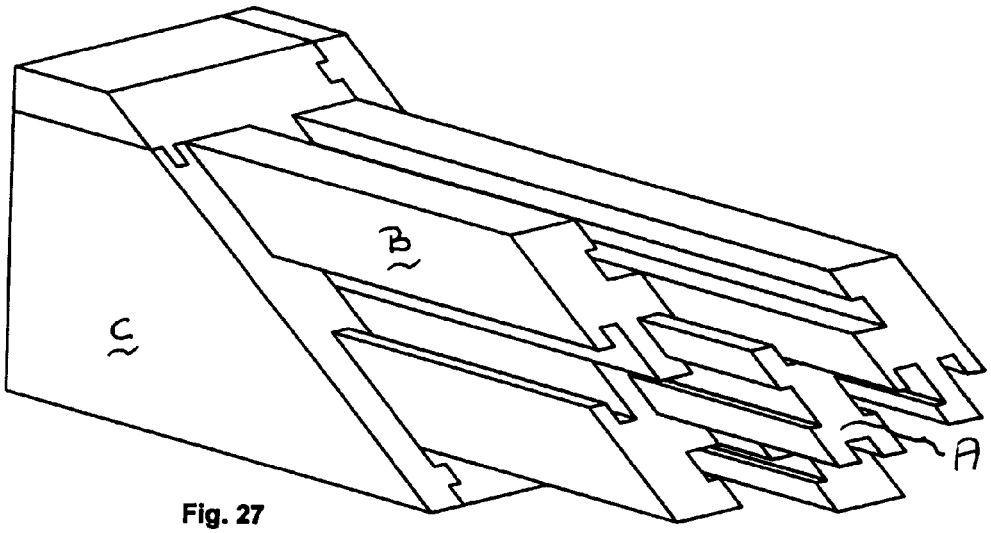
FIG. 27 schematically shows an axonometric view of a combination of the elements A, B and C of different lengths cut at an angle different from 90°.

FIG. 27 illustrates a structural system according to the invention with an oblique cut.

Figure 28:
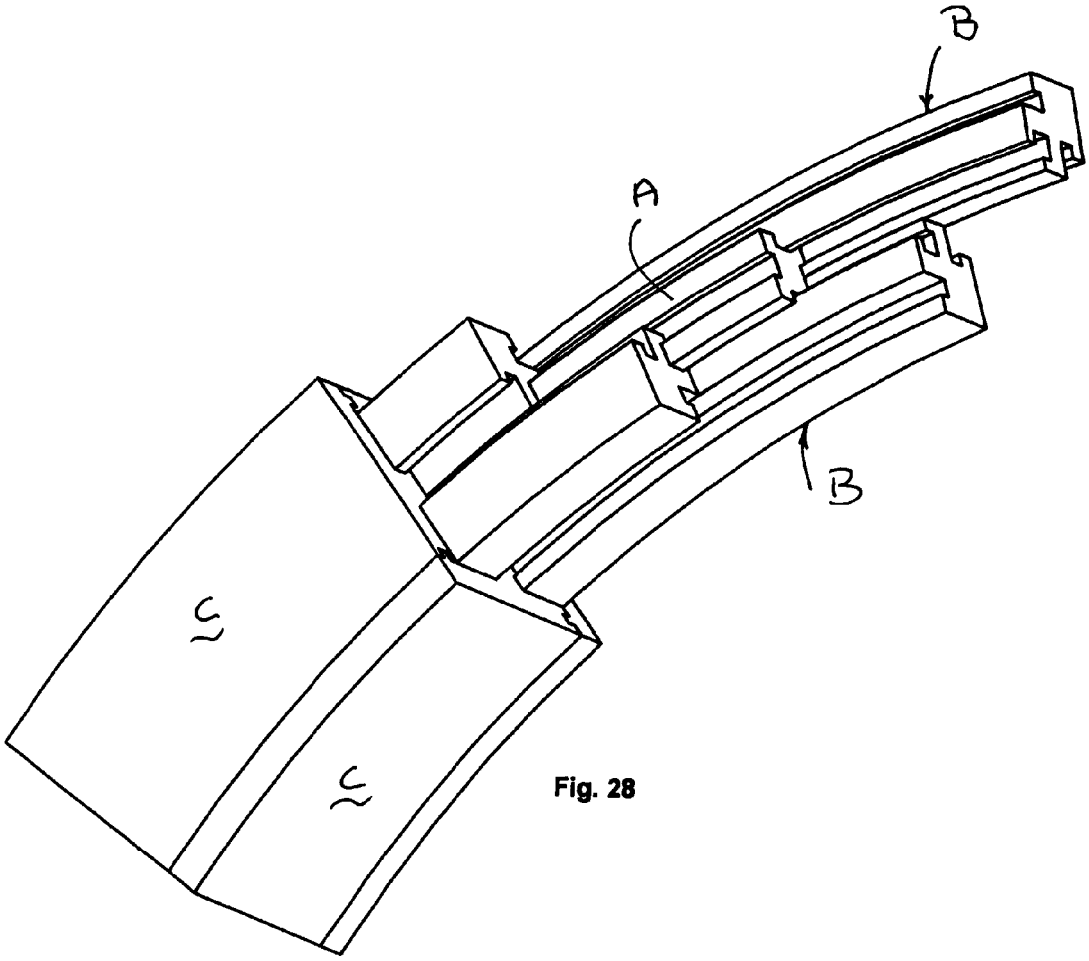
FIG. 28 schematically shows an axonometric view of a combination of the elements A, B and C of different lengths formed with a curved shape.

FIG. 28 illustrates a structural system according to the invention having a curved shape.

Figure 29:
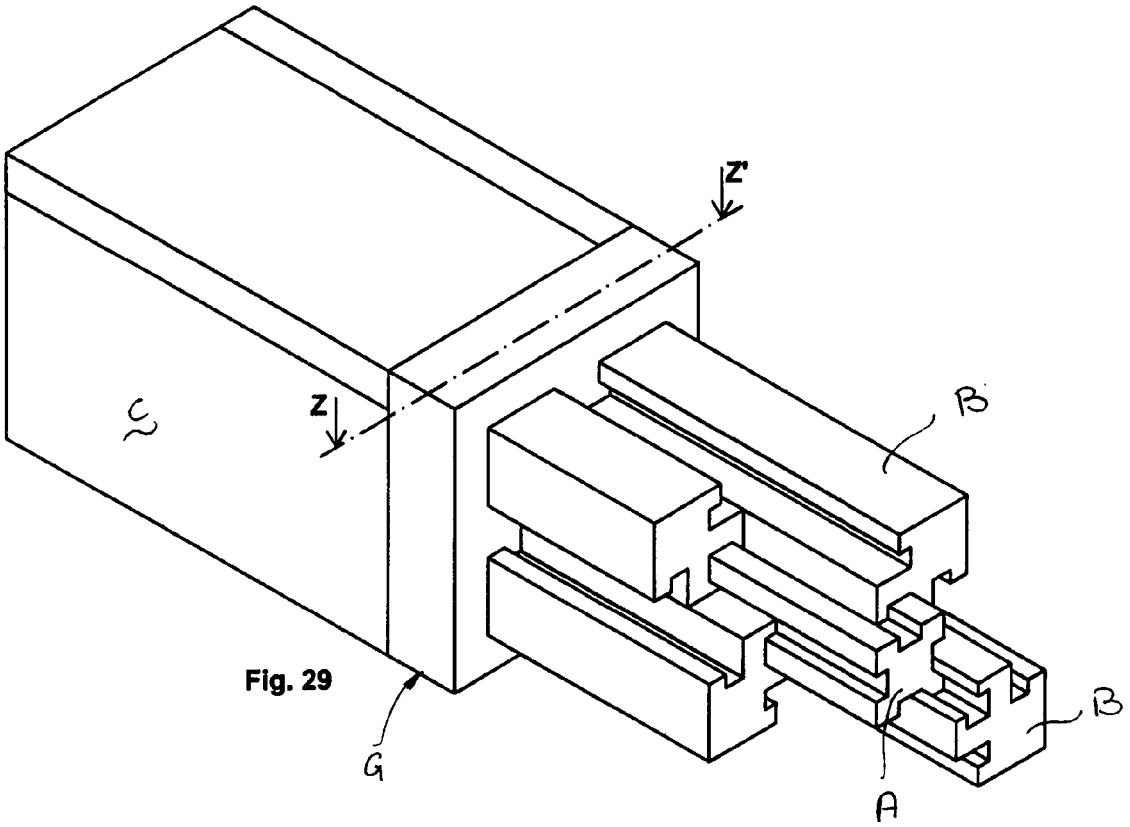
FIG. 29 shows the same view as that in FIG. 13, but horizontally, where an element G is applied onto the elements C.
Figure 30:
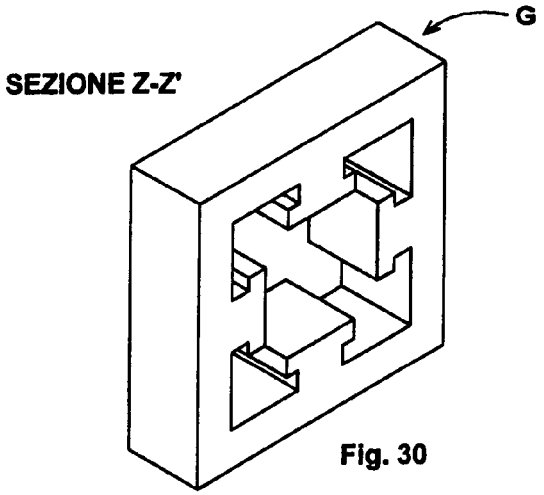
FIG. 30 schematically shows the cross-section along z-z' in the view of FIG. 29, showing the element G cross-sectioned.

FIG. 29 illustrates a structural system according to the invention which contains a particular element G obtained by the casting together of four elements C adjacent to each other.

Figure 31:
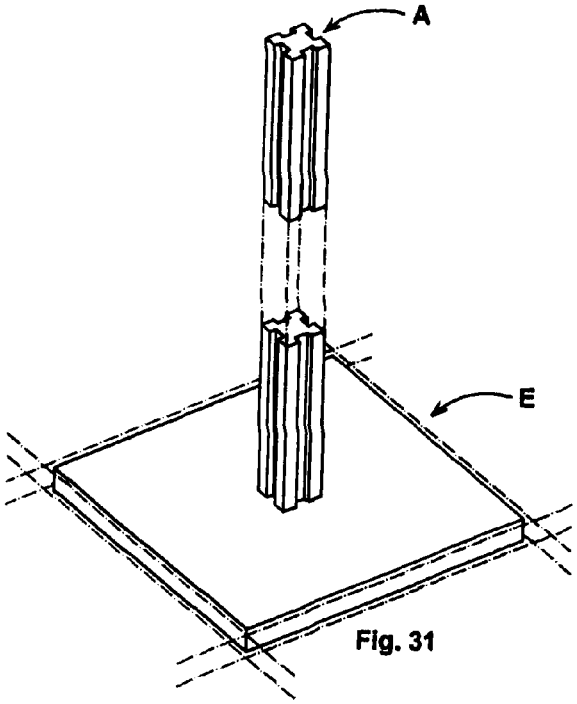
FIG. 31 schematically shows an axonometric view of an element A placed on a base E.
Figure 32:
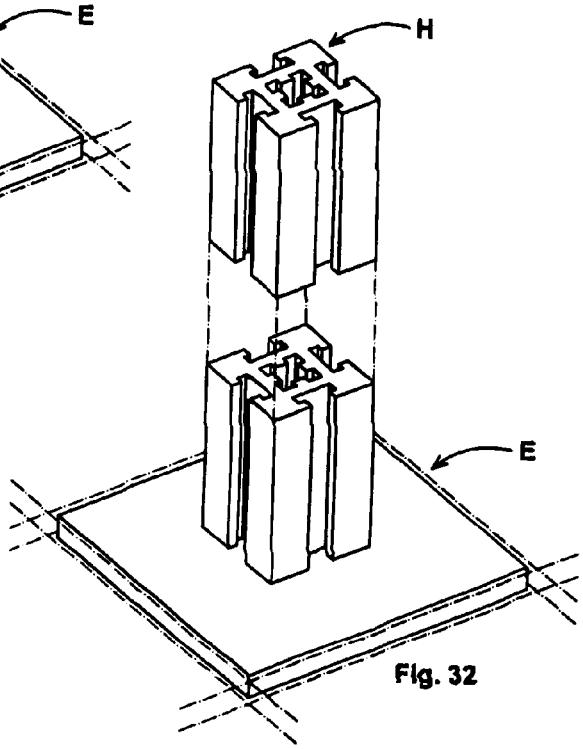
FIG. 32 schematically shows an axonometric view of four elements B cast together and placed on a base E.
Figure 33:
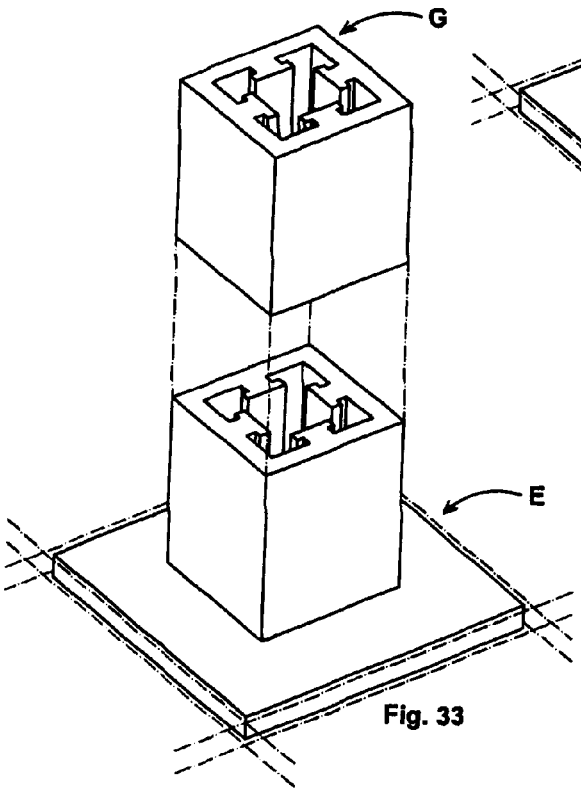
FIG. 33 schematically shows an axonometric view of four elements C cast together and placed on a base E.

FIGS. 31, 32, 33 illustrate the embodiment of a structural system according to the invention, obtained by positioning the element A on a base E in a permanent or releasable manner (FIG. 31). FIG. 32 shows a further embodiment obtained by positioning in a permanent or releasable manner on a base E four elements B which in this embodiment are cast together as a single element H which can completely surround the element A. FIG. 33 shows a further embodiment obtained by positioning in a permanent or releasable manner on a base E four elements C which in this embodiment are cast together as a single element G.

Figure 34:
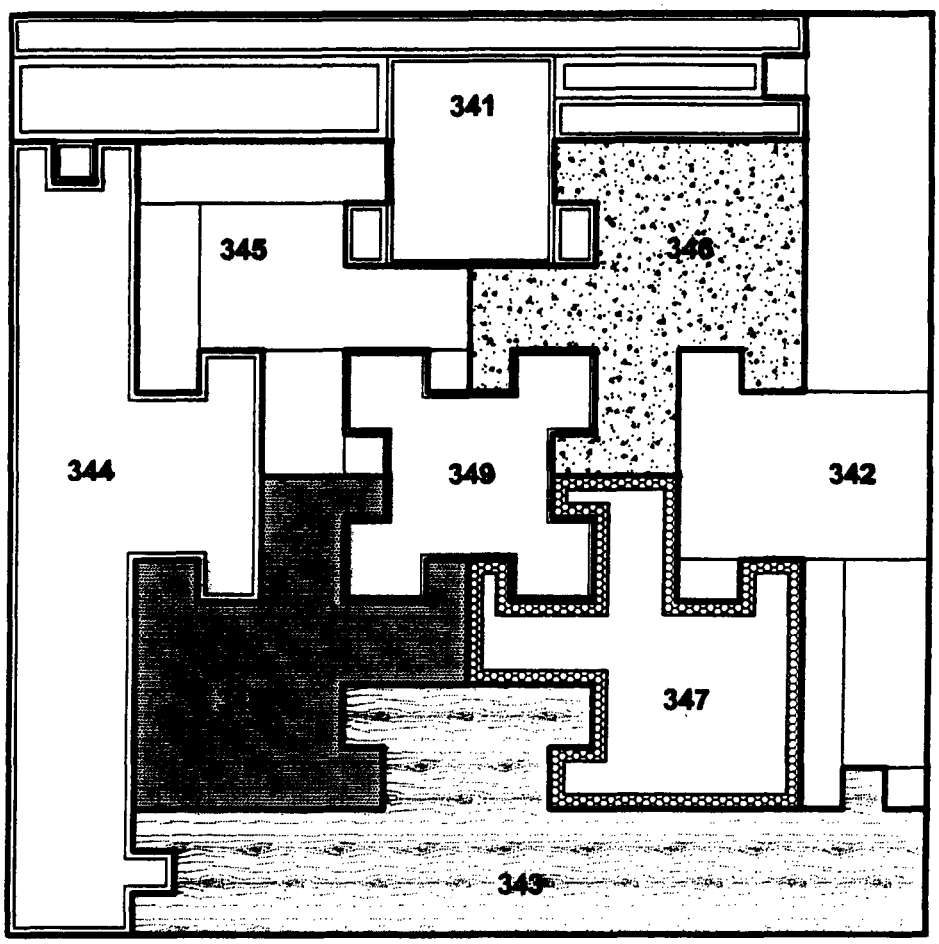
FIG. 34 schematically shows the cross-section of FIG. 14 in which the various elements A, B, C are made up in different ways and with different materials.

FIG. 34 shows an illustrative cross-section of different ways of forming the single elements A, B, C (D and C' not shown) in which:

a. one or more or all the elements (namely A or B or C) is/are formed as a hollow article of a given thickness, different thicknesses being possible depending on the requirements for the structural element as a whole;
b. one or more or all the elements (namely A or B or C) is/are formed as a solid or hollow article filled with particulate materials of a different nature (metals/glass/plastics/inert materials), different piece/particle sizes being possible depending on the requirements for the structural element as a whole;
c. one or more or all the elements (namely A or B or C) is/are formed as an article divided up into sub-assemblies which, when assembled together, recompose the element as a whole, an unlimited plurality of sub-assemblies being possible depending on the requirements for the structural element as a whole;
d. all the combinations a/b/c are possible.

In FIG. 34: 341 indicates an element C consisting of hollow portions with a regular geometric shape of varying thickness made with different materials; 342 indicates an element C composed of solid portions with a regular geometrical shape, made of various materials; 343 indicates a solid element C made of wood; 344 indicates a hollow element C of given thickness made of metal; 345 indicates an element B consisting of solid portions with a regular geometric shape, made of different materials; 346 indicates a solid element B made of cement; 347 indicates a hollow element B of given thickness made of a cellular material; 348 indicates a solid element B made of plastic material; 349 indicates a hollow element A of given thickness made of metal.

The particular embodiments described here must not be regarded as limiting the scope of the present invention, which embraces all the variants defined by the claims.

The invention claimed is:

1. A structural system having a plurality of elongated elements in sliding engagement; said structural system comprising:

(a) a first element A having an elongated shape and having a substantially quadrangular section whose perimeter is provided with protrusions and recesses which form sliding channels or tracks for mutual sliding of additional elongated elements which form the structural system;

(b) a second element B or a plurality of elements B, each element B having a section whose perimeter is provided with protrusions and recesses which form sliding channels or tracks for mutual sliding engagement with the elongated element A or additional elongated elements which form the structural system, wherein the external perimeter of said quadrangular element A being surrounded substantially completely by and slidably engaged with perimeter portions of four consecutive and adjacent elements B;

the perimeter of each of the four consecutive and adjacent elements B designed to be inserted in portions of the perimeter of said quadrangular element A with mutual male/female engagement on two consecutive sides of said quadrangular element A, other parts of element A are in contact with perimeter portions of two of said four elements B, while the remaining perimeter of element B either defines perimeter portions of the section of the structural element or constitutes an element for insertion into perimeter portions of further third, or third and fourth, elements by means of slidable mutual male/female engagement.

2. The structural system according to claim 1, wherein the quadrangular element A and the element B or elements B have a substantially square or rectangular shape.

3. The structural system according to claim 1, wherein the element A is central and is structurally and slidably connected to four elements B, and the four elements B are cast together to form a monobloc, and optionally the connections between two adjacent elements B are of the dovetail type.

4. The structural system according to claim 1, further comprising at least one node element C' shaped so that it has two opposite surfaces, substantially parallel to each other, having an extended surface area that is bigger than the surface area of the remaining pairs of opposite surfaces, one of the two extended opposite surfaces being provided with protrusions and sliding channels or tracks for mutual male/female engagement with corresponding sliding channels or tracks of second elements B, and the second parallel opposite surface being provided with a permanent or releasable connection with said first element A and second elements B.

5. The structural system according to claim 1, further comprising at least one node element C' shaped so that it has two opposite surfaces, substantially parallel to each other, having an extended surface area that is bigger than the surface area of the remaining pairs of opposite surfaces, one of the two extended opposite surfaces being provided with protrusions and sliding channels or tracks for mutual male/female engagement with corresponding sliding channels or tracks of second elements B, and the second parallel opposite surface being provided with a permanent or releasable connection with:

said first element A, said second element B, a fourth element D, or additional elements, that form the structural system at a variable connection angle $\alpha$ in the range $0 < \alpha < 180°$ with respect to said opposite surfaces, and wherein the permanent or releasable connection: comprises fixing means or systems selected from the group consisting of: screws, bolts, glues, welds, pins, clinching, riveting, hemming, sealing, screwing, interlocking engagement or snap-engagement, and magnetic systems; or, is formed integrally between element C' and the various other elements A, B, C, D, wherein optionally the elements A, B, C, D, C' are solids generated from a flat figure which moves in space and has a barycenter and which remains orthogonal to the trajectories described by its points, the trajectory of the barycenter of the flat figure being said axial line, while the flat figure forms the section of each element A, B, C, D, C'.

6. The structural system according to claim 1, wherein the elements that form the structural system are:

(a) solid or hollow; or (b) hollow with variable thickness.

7. The structural system according to claim 1, wherein the materials from which the single structural elements A, B, C, D, C' or portions thereof are made are chosen from: cementitious or cement-like materials, glass, polymeric materials, metals and alloys, wood, composite materials, wherein optionally the composite materials comprise metallic and non-metallic laminates, stratified materials, cellular or honeycomb materials with open and/or closed cells, and combinations thereof, wherein optionally the internal shape of the section of elements A, B, C, D, C' is solid to produce a solid element or is hollow to produce a boxed or a hollow element, and optionally the boxed elements and the hollow elements in the structural elements A, B, C, D, C' are formed independently of each other, and optionally the boxed elements and/or the hollow element in the structural elements are filled with materials selected from the group consisting of: cementitious or cement-like materials, glass, polymeric materials, metals and alloys, wood, composite materials, metallic laminates, non-metallic laminates, stratified materials, cellular or honeycomb materials with open and closed cells, cellular or honeycomb materials with open or closed cells, and combinations thereof, and optionally the internal volume of boxed elements are filled with liquids or gases, or liquids and gases, or is filled with solid, liquid and gaseous material, and optionally the internal volume of the hollows in the structural elements is filled with liquids or gases, or is filled with liquids and gases, or is filled with combinations of solid, liquid and gaseous materials, and optionally the structural system further comprises nodes selected from the group consisting of: nodes A", B" and C".

8. The structural system according to claim 1, wherein elements A and B are arranged for making linear structures, wherein optionally the linear structures are curved, vertical or horizontal structures, wheren optionally the structures are pillars or beams, or the structures are for making modular games and construction games, or the structures are to be used in different application sectors selected from the group consisting of: construction, mechanical engineering, transportation, furnishing and ornamental objects.

9. A Node A" comprising a combination of three, four, five or six or more elements A as set forth in claim 1, wherein the elements A are combined or cast together as a monobloc, optionally cast together at their origin, optionally originally cast together.

10. A node B" comprising a combination of three, four, five or six or more groups of elements B as set forth in claim 1, wherein the groups of elements B comprise single elements or are cast as a monobloc, and optionally the elements A are combined or cast together as a monobloc, optionally cast together at their origin, optionally originally cast together.

11. A node comprising a plurality of node elements C', wherein each node element C' comprises two opposite surfaces substantially parallel to each other and having an extended surface area that is bigger than the surface area of the remaining pairs of opposite surfaces, one of the two extended opposite surfaces comprising protrusions and sliding channels or tracks for mutual male/female engagement with corresponding sliding channels or tracks of an element B, and the second parallel opposite surface being provided with a permanent or releasable connection with:

(i) element A, (ii) element B, or (iii) element A and B, and optionally also with other elements that form the structural system of claim 1, at a variable connection angle $\alpha$ in the range $0 < \alpha < 180°$ with respect to said opposite surfaces, wherein optionally the node elements C' are identical to each other, and optionally the structural system comprises up to four nodes.

12. A manufactured object comprising the structural system of claim 1.

13. The structural system of claim 1, further comprising:

one element C or a plurality of third elements C; wherein the element C or elements C comprise a section whose perimeter is designed to be inserted in portions of the perimeter of an element B, and where more than one elements C are present, in perimeter portions of other adjacent elements C with mutual male/female engagement, and optionally the remaining perimeter portions of elements C define external perimeter portions of the overall final section of the structural system.

14. The structural system according to claim 13, wherein the quadrangular element A is central and is structurally and slidably connected to four elements B which are in turn are structurally and slidably connected to four elements C, and optionally the four elements C are structurally and slidably connected to four elements D, wherein optionally the four elements C are cast together to form a monobloc.

15. The structural system of claim 1, further comprising:

one element C or a plurality of third elements C, and one fourth element D or a plurality of fourth elements D;

wherein the element C or elements C comprise a section whose perimeter is designed to be inserted in portions of the perimeter of an element B and in perimeter portions of other adjacent elements C and an additional element D or elements D with mutual male/female engagement, and optionally the remaining perimeter portions of element C define external perimeter portions of the overall final section of the structural system;

and perimeter portions of said elements C and elements D surrounding in a substantially complete manner the perimeter portions of the elements B which are not engaged during mutual sliding with the element A.

16. The structural system according to claim 15, wherein the element D or elements D have a section whose perimeter is able to partially slidably engage with perimeter portions of an element C and with mutual male/female engagement, and optionally the remaining perimeter portions of the element D or elements D define external perimeter portions of the overall final section of the structural system.

17. A node comprising a plurality of elements A and B, and at least one node element C', wherein each at least one node element C' comprises two opposite surfaces substantially parallel to each other and having an extended surface area that is bigger than the surface area of the remaining pairs of opposite surfaces, wherein one of the two extended opposite surfaces comprises protrusions and sliding channels or tracks for mutual male/female slidable engagement with corresponding sliding channels or tracks of the element B, and the second parallel opposite surface being provided with a permanent or releasable connection with the element A and the element B, and optionally further comprising other elements that form a structural system according to claim 2, at a variable connection angle $\alpha$ in the range $0 < \alpha < 180°$ with respect to said opposite surfaces, wherein optionally the node further comprises at least one element C, and optionally further comprises elements D and C', and the node is obtained by a sliding combination of the male female type with elements C and optional elements D and node elements C'.

18. A node C" comprising a combination of three, four, five or six groups or more of elements C as set forth in claim 15, and optionally the elements C are combined or cast together as a monobloc, optionally cast together at their origin, optionally originally merged together.

19. The structural system of claim 1, wherein the sliding channels or tracks are of the square type with surfaces which are parallel or realized rounded with beveled surfaces.

20. The structural system of claim 1, wherein the structural system has an overall section with an external perimeter substantially shaped as a circle, ellipse or a regular polygon, or a square or rectangle.

21. The structural system of claim 1, wherein the structural system has a predefined length which is obtained by assembling elements A and B having lengths different from each other until the predefined length is reached.

22. The structural system of claim 21, wherein the structural system has a predefined length which is obtained by assembling elements A and B and additional structural elements having lengths different from each other until the predefined length is reached.

23. The structural system of claim 1, further comprising:

(a) a node selected from the group consisting of nodes A", B" and C", wherein:

node A" comprises a plurality of elements A, and optionally comprising three, four five or six or more elements A, and optionally said elements A being combined together or cast together as a monobloc; or node B" comprises a plurality of elements, optionally a combination of four elements B, wherein the elements B are combined in a group, and optionally comprising three, four, five or six or more group elements B, optionally said elements B are combined or cast together as a monobloc; or (b) a node selected from among nodes A", B", C", wherein:

node A" comprises a plurality of elements A, and optionally comprising three, four five or six or more elements A, and optionally said elements A being combined together or cast together as a monobloc;

node B" comprises a plurality of elements, optionally a combination of four elements B, wherein the elements B are combined in a group, and optionally comprising three, four, five or six or more group elements B, optionally said elements B being combined or cast together as a monobloc; or node C" comprises a plurality of elements, optionally a combination of four elements C, wherein the elements C are combined in a group, and optionally comprising three, four, five or six or more group elements C, optionally said elements C being combined or cast together as a monobloc.

24. The structural system of claim 1, further comprising: additional elements C at a variable connection angle $\alpha$ in the range $0 < \alpha < 180°$ with respect to said opposite surfaces, wherein optionally the additional elements C are a third element C or a fourth element C.

25. A structural assembly comprising:

two or more structural systems according to claim 1, wherein the two or more structural systems are connected to each other by at least one node element C' shaped so that it has two opposite surfaces, substantially parallel to each other, having an extended surface area that is bigger than the surface area of the remaining pairs of opposite surfaces, one of the two extended opposite surfaces being provided with protrusions and sliding channels or tracks for mutual male/female engagement with corresponding sliding channels or tracks of second elements B, and the second parallel opposite surface being provided with a permanent or releasable connection with:

(i) said first element A, (ii) said second element B, (iii) said first element A and second element B, or (iv) any of (i), (ii) or (iii) and additional elements, that form the structural system, wherein the elements have a connection angle $\alpha$ in the range of between about $0 < \alpha < 180°$ with respect to said opposite surfaces;

or with a node selected from among the nodes A", B", C", wherein node A" comprises a plurality of elements A, and optionally comprising or more three, four five or six or more elements A, and optionally said elements A being combined together or cast together as a monobloc;

node B" comprises a plurality of elements, optionally a combination of four elements B, wherein the elements B are combined in a group, and optionally comprising three, four, five or six or more group elements B, optionally said elements B being combined or cast together as a monobloc.

26. A manufactured object comprising the structural system of claim 25.

27. A structural assembly comprising:

two or more structural systems according to claim 1, wherein the at least two or more structural systems are connected to each other by a node element C' shaped so that it has two opposite surfaces, substantially parallel to each other, having an extended surface area that is bigger than the surface area of the remaining pairs of opposite surfaces, one of the two extended opposite surfaces being provided with protrusions and sliding channels or tracks for mutual maleifemale engagement with corresponding sliding channels or tracks of second elements B, and the second parallel opposite surface being provided with a permanent or releasable connection comprising:

(i) said first element A, (ii) said second element B, (iii) said first element A and second element B, or (iv) any of (i), (ii) or (iii) and additional elements, that form the structural system at a variable connection angle $\alpha$ in the range $0 < \alpha < 180°$ with respect to said opposite surfaces;

or with a node selected from among the nodes A", B", C", wherein node A" comprises a plurality of elements A, and optionally comprising three, four five or six or more elements A, and optionally said elements A being combined together or cast together as a monobloc;

node B" comprises a plurality of elements, optionally a combination of four elements B, wherein the elements B are combined in a group, and optionally comprising three, four, five or six or more group elements B, optionally said elements B being combined or cast together as a monobloc; or node C" comprises a plurality of elements, optionally a combination of four elements C, wherein the elements C are combined in a group, and optionally comprising three, four, five or six or more group elements C, optionally said elements C being combined or cast together as a monobloc.

28. A manufactured object comprising the structural system of claim 27.

29. A structural system having a set section obtained from a combination in sliding engagement form of elongated elements; said system comprising:

an element A, and an element B and optionally an element C or C', wherein optionally the structural system comprises: a plurality of elements B, or four elements B; a plurality of elements C, or four elements C; or, a node element C or a plurality of node elements C', wherein the element A has a substantially square section in which sliding grooves or longitudinal tracks (1) are provided symmetrically, being distributed on the four sides of the section and defining the protruding parts (2) which can slidingly engage inside corresponding complementary grooves in the element B; and the element B has a substantially square section in which the sliding grooves or longitudinal tracks (3), (4) and (5) are provided on three of the four corners of the section, said grooves or tracks (4) and (5) being mirror-image of each other and different from the groove or track (3), which is shaped so that it can be coupled with and can accommodate the protruding parts (2) of element A;

wherein the external perimeter of said element A being surrounded substantially completely by perimeter portions of four consecutive and adjacent elements B;

wherein the perimeter of said element B or elements B are inserted in portions of the perimeter of A with mutual slidable male/female engagement on two consecutive sides of said element A, other parts of element A are in contact with perimeter portions of two of said four elements B, and the remaining perimeter of element or elements B either define perimeter portions of the section of the structural element or constitutes an element for slidable insertion into perimeter portions of:

(i) one or more elements B;

(ii) one or more elements C; or (iii) one or more elements B and C;

by means of mutual slidable male/female engagement; and wherein optionally the grooves or tracks (4) and (5) further being shaped so that they can slidingly engage with corresponding complementary protrusions of the element C or the node element C';

wherein the element C is substantially shaped so that it has two opposite extended surfaces (6) and (7) substantially parallel to each other and having a surface area that is bigger than the surface area of the remaining pairs of parallel and opposite surfaces (8), (9) and (10), the pairs of surfaces 10 being identical to each other; the opposite extended surface (7) being provided with a protrusion (11) forming two sliding channels or tracks (12) which are parallel and opposite to each other and a protrusion (13) parallel to the channels or tracks (12) on the side where the lateral surface (9) is located; the lateral surface (8), which is parallel and opposite to the lateral surface (9), having a sliding groove or track (14) parallel to the channels or tracks (12).

30. The structural system according to claim 29, wherein: the node element C' has the same protrusions and sliding channels or tracks as the element C, and is different from the element C in that on the opposite extended surface (6), which is parallel and opposite to the opposite extended surface (7), and further comprises a permanent or releasable connection with said first element A and second elements B and optional other elements C at a connection angle $\alpha$ in the range $0 < \alpha < 180°$, or at $\alpha = 90°$, with respect to the opposite extended surface (6).

31. The structural system according to claim 29, wherein: the channels or tracks (12) and the protrusion (11) are able to engage slidingly with corresponding complementary protrusions or tracks of generic elements B; the protrusions (13) and the grooves or tracks (14) are able to slidingly engage with corresponding complementary tracks or protrusions of other elements C, wherein optionally the node element C' has connected to it elements A, B, C arranged to form a structural assembly.

* * * * *